US007792456B2

(12) United States Patent
Okamoto et al.

(10) Patent No.: US 7,792,456 B2
(45) Date of Patent: Sep. 7, 2010

(54) IMAGE FORMING APPARATUS HAVING ACCURATE INTERNAL TEMPERATURE CONTROL

(75) Inventors: Kiyoshi Okamoto, Moriya (JP); Yuichiro Maeda, Kashiwa (JP); Noriaki Matsui, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 73 days.

(21) Appl. No.: 12/323,412

(22) Filed: Nov. 25, 2008

(65) Prior Publication Data

US 2009/0136242 A1 May 28, 2009

(30) Foreign Application Priority Data

Nov. 27, 2007 (JP) ..... 2007-305994

(51) Int. Cl.
*G03G 15/00* (2006.01)
*G03G 15/08* (2006.01)
*G03G 21/20* (2006.01)

(52) U.S. Cl. ..... 399/92; 399/13; 399/262

(58) Field of Classification Search ..... 399/13, 399/92, 91, 94, 120, 262, 111, 110
See application file for complete search history.

(56) References Cited

U.S. PATENT DOCUMENTS 6,185,382 B1 2/2001 Knott et al.
6,807,380 B2 * 10/2004 Iida et al. ..... 399/13 X
2006/0204271 A1 9/2006 Tai et al.
2009/0060560 A1 * 3/2009 Tamura et al. ..... 399/92

FOREIGN PATENT DOCUMENTS

| | | | |
|---|---|---|---|
| JP | 08-328452 A | * | 12/1996 |
| JP | 2000-187415 | | 7/2000 |
| JP | 2003-263022 | | 9/2003 |
| JP | 2006-163143 | | 6/2006 |
| JP | 2006-259597 | | 9/2006 |

* cited by examiner

*Primary Examiner*—Sophia S Chen
(74) *Attorney, Agent, or Firm*—Canon USA Inc IP Div

(57) ABSTRACT

An image forming apparatus to which a developer storage container can be detachably mounted, includes: a reception unit arranged to receive information from the developer storage container; a first temperature detection unit provided in an inside of the image forming apparatus and arranged to detect a temperature of the inside of the image forming apparatus; a cooling unit arranged to cool the inside of the image forming apparatus; and a control unit arranged to determine on the basis of the received information whether second temperature detection unit is provided to the developer storage container, control the cooling unit on the basis of the detection result of the first temperature detection unit when the second temperature detection unit is not provided, and control the cooling unit on the basis of the detection results of the first and second temperature detection units when the second temperature detection unit is provided.

7 Claims, 21 Drawing Sheets

FIG. 10

| |
|---|
| CHIP ID (UNIQUE ID) |
| PRODUCT TYPE |
| TONER TYPE |
| PRODUCTION DATE |
| PRINT COUNTER |
| REMAINING AMOUNT LIMIT |
| STATUS |
| USE STARTING DATE |
| NUMBER OF TEMPERATURE SENSORS |
| ARRANGEMENT DATA 1 (ATTACHED FACE) |
| ARRANGEMENT DATA 2 (ATTACHED POSITION) |
| TEMPERATURE DATA 1 |
| TEMPERATURE DATA 2 |
| TEMPERATURE DATA 3 |
| TEMPERATURE DATA MAX |
| TEMPERATURE DATA MIN |

MESSAGE:
TEMPERATURE OF TONER [PRODUCT NUMBER XXXX] CONTAINER IS TOO HIGH.

FIG. 16

| DATA TYPE | DATA | |
|---|---|---|
| NUMBER OF TEMPERATURE SENSORS | 6 | |
| TEMPERATURE SENSOR TABLE ID (1) | 0: INSIDE IMAGE FORMING APPARATUS | PORT DATA, BIT DATA |
| (2) | 0: INSIDE IMAGE FORMING APPARATUS | PORT DATA, BIT DATA |
| (3) | 1: YCRG | 3: ARRANGEMENT DATA 1, 200: ARRANGEMENT DATA 2 |
| (4) | 2: MCRG | 3: ARRANGEMENT DATA 1, 350: ARRANGEMENT DATA 2 |
| (5) | 3: CCRG | 3: ARRANGEMENT DATA 1, 550: ARRANGEMENT DATA 2 |
| (6) | 4: KCRG | 3: ARRANGEMENT DATA 1, 50: ARRANGEMENT DATA 2 |
| ... | ... | ... |

FIG. 17

| DATA TYPE | DATA |
|---|---|
| NUMBER OF ASSOCIATED TEMPERATURE SENSORS | 2 |
| TEMPERATURE SENSOR ID (1) | 2 |
| (2) | 6 |
| (3) | |
| ... | ... |

IMAGE FORMING APPARATUS HAVING ACCURATE INTERNAL TEMPERATURE CONTROL

BACKGROUND OF THE INVENTION

1. Field of the Invention

The present invention relates to an image forming apparatus to which a developer storage container having a function of communicating with the image forming apparatus can be detachably mounted.

2. Description of the Related Art

Up to now, by exchanging management information between an image forming apparatus main body and a developer storage container (for example, a toner cartridge), management of the toner cartridge is efficiently and easily conducted to improve a usability such as maintenance of the image forming apparatus.

For example, Japanese Patent Laid-Open No. 2003-263022 proposes the following technique. Change in temperature from production of the toner cartridge to delivery to a user and also in a storage environment is stored as temperature history information. When the toner cartridge is set to the image forming apparatus, a period of time for conducting a toner agitating control is changed on the basis of the temperature history information. This technique is for changing the agitating time in accordance with a toner condition because the concentration rate of the toner is varied depending on the toner storage condition.

In an image forming apparatus of recent years, along with a decrease in the melting point of the toner, a more precise temperature control is demanded for the inside of the image forming apparatus, and an environment control such as an air flow control for the inside of the image forming apparatus needs to be performed.

However, according to the technique described in Japanese Patent Laid-Open No. 2003-263022, a temperature sensor arranged to detect temperature change up to until the toner cartridge is delivered to the user is provided, but this temperature sensor is not effectively utilized after the toner cartridge is mounted to the image forming apparatus.

Therefore, when the toner cartridge is mounted to the image forming apparatus, the environment control such as the temperature control for the inside of the image forming apparatus or the air flow control for the inside of the image forming apparatus cannot be performed by using the temperature sensor inside the toner cartridge.

SUMMARY OF THE INVENTION

In view of the above, the present invention provides an image forming apparatus capable of dealing with the decrease in the melting point of toner through an environment control by detecting a temperature in the inside of the image forming apparatus more accurately without increasing costs.

According to an embodiment of the present invention provides, there is provided an image forming apparatus to which a developer storage container can be detachably mounted, the image forming apparatus including: a reception unit arranged to receive information from the developer storage container; a first temperature detection unit provided in an inside of the image forming apparatus and arranged to detect a temperature of the inside of the image forming apparatus; a cooling unit arranged to cool the inside of the image forming apparatus; and a control unit arranged to determine on the basis of the information received by the reception unit whether second temperature detection unit is provided to the developer storage container, control the cooling unit on the basis of the detection result of the first temperature detection unit in a case where the second temperature detection unit is not provided to the developer storage container, and control the cooling unit on the basis of the detection results of the first temperature detection unit and the second temperature detection unit in a case where the second temperature detection unit is provided to the developer storage container.

Further features of the present invention will become apparent from the following description of exemplary embodiments with reference to the attached drawings.

BRIEF DESCRIPTION OF THE DRAWINGS

FIG. 10 illustrates an example of data structure stored in the wireless IC chip unit.

FIG. 16 is a structural drawing of a temperature sensor data table for storing data of the temperature sensor provided inside the image forming apparatus.

FIG. 17 is a structural drawing of a temperature sensor data table for each fan provided inside the image forming apparatus.

DESCRIPTION OF THE EMBODIMENTS

Figure 1:
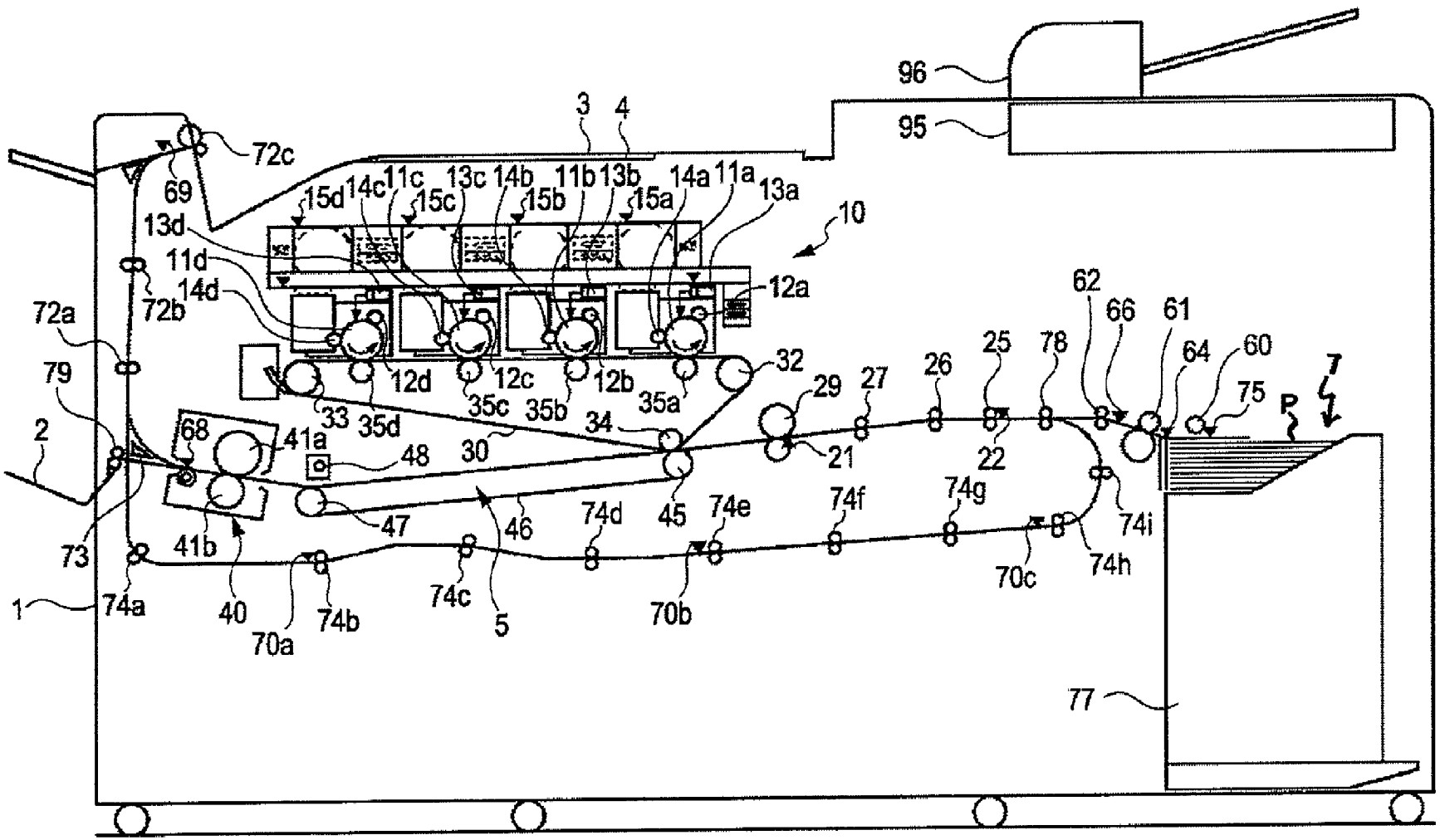
FIG. 1 is a vertical cross-sectional view of a schematic configuration of an image forming apparatus according to an embodiment of the present invention.
Figure 2:
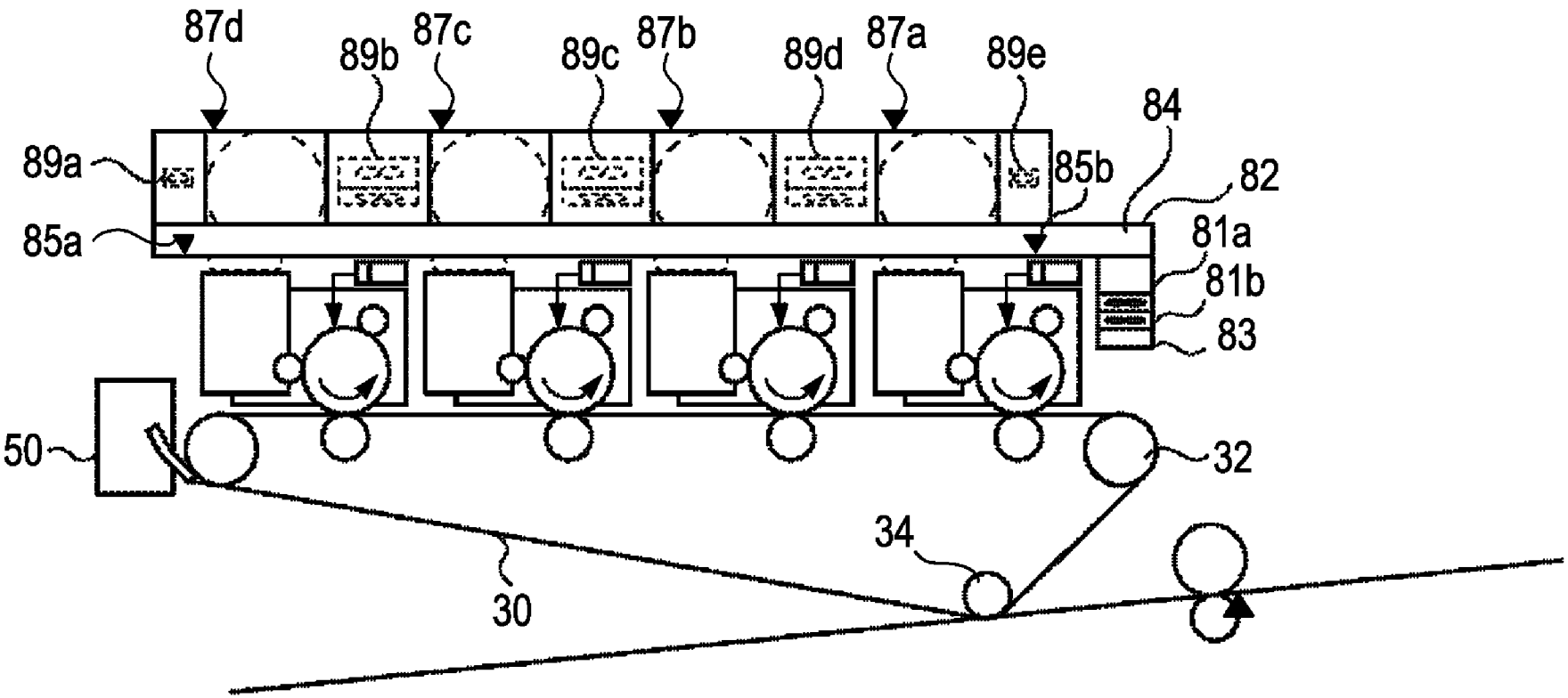
FIG. 2 is another vertical cross-sectional view of a schematic configuration of the image forming apparatus.

FIGS. 1 and 2 are cross-sectional views of an image forming apparatus 1 according to an embodiment of the present invention. The image forming apparatus 1 is composed of an image forming unit 10, a paper feed unit 7, an intermediate transfer unit 5, a fixing unit 40, an operation unit 4, a control unit 100 (refer to FIG. 4), and the like.

In the image forming unit 10, four stations are arranged in parallel and have the same configuration. In the image forming unit 10, photosensitive drums 11*a*, 11*b*, 11*c*, and 11*d* functioning as image bearing members are axially supported about the center thereof, and rotated and driven by a drive motor in an arrow direction.

While facing outer circumference surfaces of the photosensitive drums 11*a* to 11*d*, roller chargers 12*a*, 12*b*, 12*c*, and 12*d*, scanners 13*a*, 13*b*, 13*c*, and 13*d*, and developing apparatuses 14*a*, 14*b*, 14*c*, and 14*d* are arranged in a rotation direction thereof.

The roller chargers 12*a* to 12*d* supply charges of a uniform electrification amount to surfaces of the photosensitive drums 11*a* to 11*d*. Next, scanners 13*a* to 13*d* expose the photosensitive drums 11*a* to 11*d* to light beam such as laser beam modified in accordance with a recording image signal to form electrostatic latent images thereon. Furthermore, the developing apparatuses 14*a* to 14*d* respectively storing developer (toner) of four colors including yellow, cyan, magenta, and black visualize the above-described electrostatic latent images. The visualized image is transferred onto an intermediate transfer belt 30. Through the above-described process, image formations based on the respective toner are sequentially performed.

Also, toner cartridges (hereinafter, referred to as toner CRGs) 87*a*, 87*b*, 87*c*, and 87*d* functioning as developer storage containers are detachably mounted to the image forming apparatus 1. By replacing the toner CRGs by a user, it is possible to perform toner replenishment. In addition, by using toner CRG set detection sensors 15*a*, 15*b*, 15*c*, and 15*d*, it is possible to detect whether the toner cartridges are mounted or not mounted.

As the developing apparatuses 14*a*, 14*b*, 14*c*, and 14*d* are provided with hoppers, it is possible to replenish the toner even while the developing apparatuses 14*a*, 14*b*, 14*c*, and 14*d* are operated. When toner sensors provided inside the developing apparatuses 14*a*, 14*b*, 14*c*, and 14*d* detect that the toner is running out, a toner conveying motor inside the hopper is operated to supply the toner inside the hopper into the developing apparatuses 14*a*, 14*b*, 14*c*, and 14*d*.

Also, the image forming unit 10 is provided with ducts 82 and 84 for supplying air from the outside into the inside of the image forming apparatus. By driving supply air fans 81*a* and 81*b*, the air from the outside is supplied through an air filter 83. As the air from the outside is supplied, the inside of the image forming apparatus is cooled down.

Temperature sensors 85*a* and 85*b* functioning as a first temperature detection unit are arranged to detect a temperature of the inside of the image forming apparatus (in the ducts 82 and 84). Exhaust air fans 89*a*, 89*b*, 89*c*, 89*d*, and 89*e* are fans for exhausting air in the vicinity of the toner CRGs to the outside of the image forming apparatus. Also, in the exhaust air fans 89*a*, 89*b*, 89*c*, 89*d*, and 89*e*, the number of the rotations of the fan can be freely controlled in a predetermined range.

Figure 3:
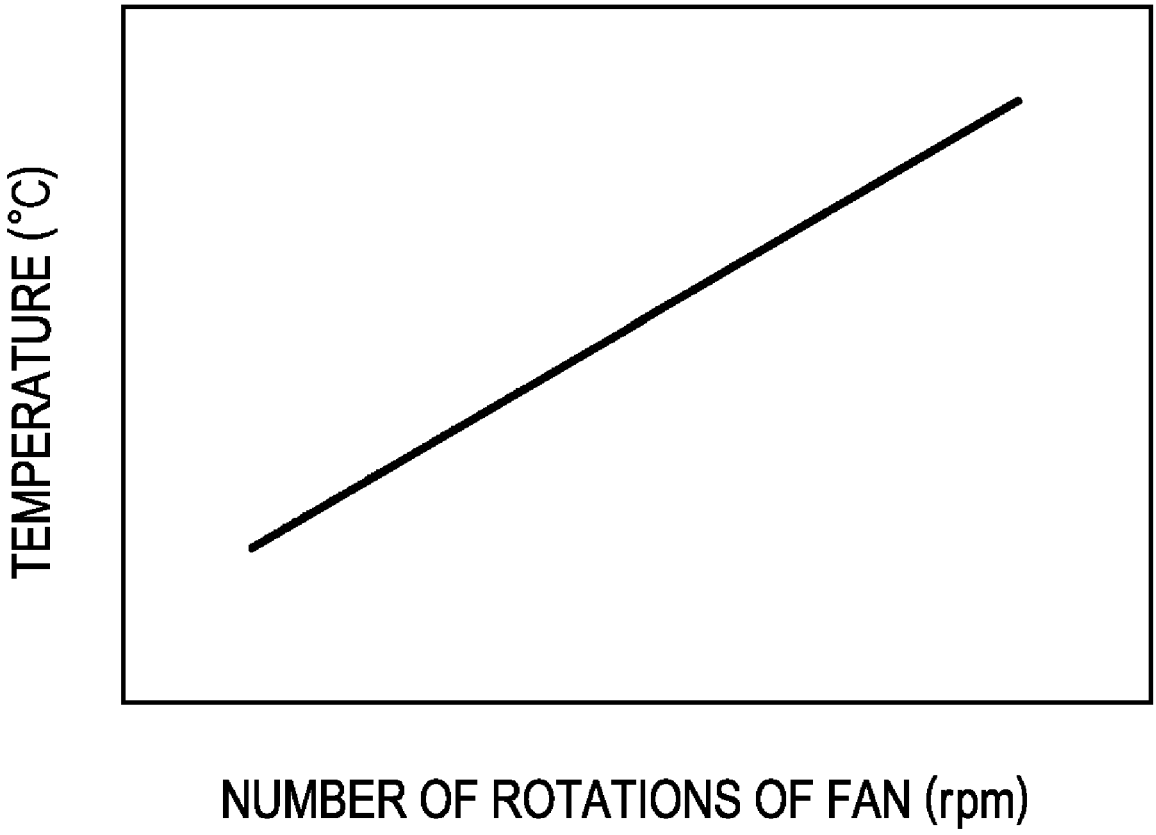
FIG. 3 illustrates a relation between a detected temperature and the number of rotations of a fan to be controlled.

FIG. 3 illustrates a relation between the detected temperature and the number of rotations of the fan. Data indicating the temperature and the number of rotations is stored in the control unit 100 as an individual data table for each fan. The control unit 100 is arranged to drive the fans on the basis of the detection results of the temperature sensors. Basically, such a control is performed that as the detected temperature is higher, the number of rotations of the fan is increased.

Next, the paper feed unit 7 is composed of a storage unit 77 for storing sheets P, rollers 60 and 61 for feeding the sheet P, a sensor 64 for checking feed of the sheet P, a sensor 66 for detecting passing of the sheet P, a sensor 75 for detecting the presence or absence of the sheet P, and the like. The pickup roller 60 is arranged to feed the sheet P from the storage unit 77 one each. In some cases, a plurality of the sheets P may be fed from the pickup roller 60, but the separation roller 61 is operated to separate the sheets P into one sheet. The sheet P separated into one sheet by the separation roller 61 is further conveyed to a pullout roller 62 and conveyed up to a pre-registration roller 78.

The paper feed unit 7 can detect an interval distance of the sheets when the previously conveyed sheet P exists by detecting the trailing end of the previously conveyed sheet P and the leading end of the sheet P picked up next and fed with use of a sheet feed conveyance sensor 66. Then, a pickup operation is started so that the interval distance of the sheets is set as a predetermined distance previously determined in accordance with the conveyance speed.

Next, the sheet P is conveyed and the leading end of the sheet P is detected by a pre-registration sensor 22. In accordance with that, conveying rollers 25, 26, and 27 are driven at a predetermined speed, and the sheet P is conveyed by the conveying rollers 25, 26, and 27. Then, as a registration sensor 21 detects the leading end of the sheet P, the sheet P is conveyed at a predetermined distance, and the leading end of the sheet P abuts against a registration roller 29. After that, the drive of the conveying rollers 25, 26, and 27 is stopped.

The leading end of the sheet P abuts against the registration roller 29 at rest, and the leading end of the sheet P is regulated, so that skew is corrected. Then, in the image forming unit 10, in accordance with a position of the image previously drawn on the intermediate transfer belt 30, the registration roller 29 and the conveying rollers 25, 26, and 27 are driven again, and registration for the sheet P is performed at the position of the image already formed on the intermediate transfer belt 30. In a case where the sheet P passes through the registration roller 29, the registration roller 29 is stopped and ready for the next skew correction. Then, the sheet P is conveyed to the intermediate transfer unit 5.

Next, a detail of the intermediate transfer unit 5 will be described. A driving roller 32 is a roller for transmitting a drive to the intermediate transfer belt 30, and rotated and driven by a stepping motor. A tension roller 33 is a roller for supplying an appropriate tensile force to the intermediate transfer belt 30 by way of bias of a spring. Driven rollers 34 are supported while sandwiching the intermediate transfer belt 30 so as to form a secondary transfer area.

On an opposite side of the intermediate transfer belt 30 at positions where the respective photosensitive drums 11*a* to 11*d* faces the intermediate transfer belt 30, primary transfer rollers 35*a* to 35*d* are arranged. The primary transfer rollers 35*a* to 35*d* are applied with a high voltage for transferring the toner image onto the intermediate transfer belt 30.

On a lower side of the intermediate transfer belt 30, a secondary transfer roller 45 for transferring the image on the intermediate transfer belt 30 onto the sheet P is arranged. With a nip between the secondary transfer roller 45 and the intermediate transfer belt 30, a secondary transfer area is formed. The secondary transfer roller 45 is pressed at an appropriate pressure against the intermediate transfer belt.

Also, a secondary transfer belt 46 which is an endless belt is supported between the secondary transfer roller 45 and a supporting roller 47 rotated and driven by a motor. The secondary transfer roller 45 abuts against the driven rollers 34 across the secondary transfer belt 46 and the intermediate transfer belt 30.

The driven rollers 34 is applied with bias of the same polarity as a toner polarity by a power source. Also, the secondary transfer roller 45 is grounded, and a secondary transfer electric field is affected between the driven rollers 34 and the secondary transfer roller 45. The sheet P on which the toner image is transferred is borne on the secondary transfer belt 46 and conveyed. Then, the sheet P is subjected to removal of electricity due to discharge of a neutralization charger 48 and separated from the secondary transfer belt 46. Then, the sheet P is conveyed to the fixing unit 40.

The fixing unit 40 includes a fixing roller 41*a* provided with a heat source such as a halogen heater inside thereof and a pressing roller 41*b* pressed by the roller. The toner image is fixed on the front face of the sheet P by the heat of the roller pair 41*a* and 41*b* and the pressure of the nip. After that, the conveyance destination is switched by a flapper 73, and the sheet P is ejected to a paper output tray 2 by a roller 79 or ejected to a paper output tray 3 by the rollers 72*a*, 72*b*, and 72*c*.

It is noted that in a conveying path of the sheet P, in addition to the above-described components, an inner paper output sensor 68, a face down paper output sensor 69, a duplex sensor 70*a*, a duplex pre-registration sensor 70*b*, a duplex refeeding sensor 70*c*, roller 74*a* through 74*i*, and the like are provided.

Also, an original feed apparatus 96 is an apparatus arranged to feed the set original onto a reading position of an image scanning apparatus 95. Then, image data of the original fed onto the reading position of the image scanning apparatus 95 is converted into image information by the image scanning apparatus 95.

On the basis of the image information of the read original image, the image forming apparatus 1 performs image formation on the sheet P, so that a copy function of the original image is realized. The operation unit 4 is used for the user to issue instructions about an image formation mode, the number of images to be formed, and an image formation condition, and for a service person to perform a maintenance work on the apparatus, for example. When a start key on the operation unit 4 is pressed, the reading operation for the original image is started, and also the image formation operation of the image forming apparatus 1 and other operations such as transmission of the original image are performed.

Control Block Diagram

Figure 4:
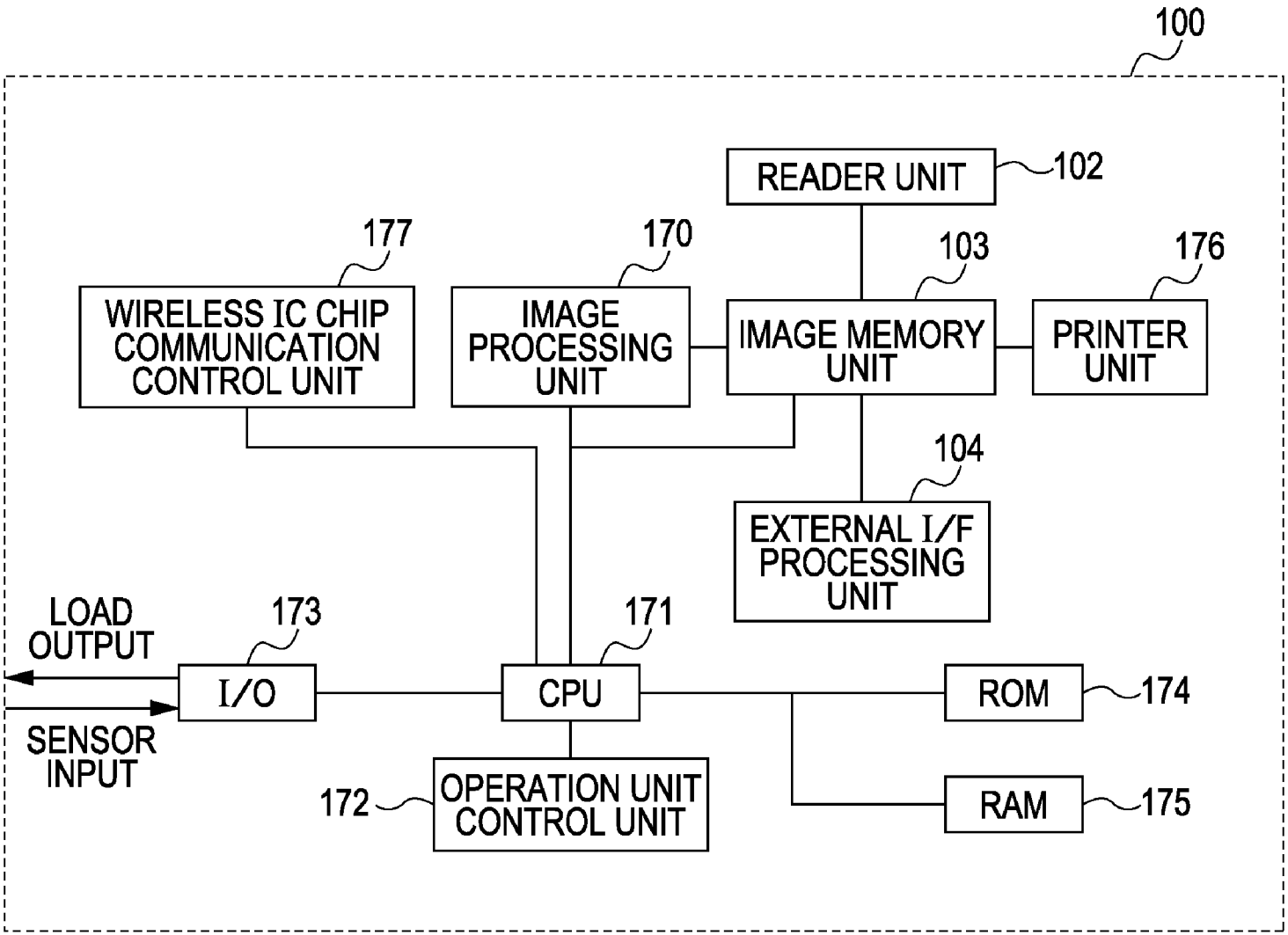
FIG. 4 is a block diagram of a control unit of the image forming apparatus.

FIG. 4 is a block diagram of the control unit 100 in the image forming apparatus 1 of FIG. 1. A CPU 171 is a circuit arranged to perform a basic control of the image forming apparatus 1. The CPU 171 is connected to a ROM 174, a RAM 175, and an input output port 173 via an address bus and a data bus. In the ROM 174, a control program is written. The RAM 175 is composed of a non-volatile memory, and can store a storage content even when the power source is turned OFF.

The input output port 173 is provided with functions for performing input and output controls at the port, an A/D or D/A conversion control, and the like. Also, to the input output port 173, a motor for controlling the image forming apparatus 1, various loads such as a clutch, a sensor for detecting a position of the sheet in the image forming apparatus, a temperature sensor for detecting a temperature, and the like are connected.

In accordance with the content of the ROM 174, the CPU 171 sequentially performs input and output controls via the input output port 173 to execute the image forming operation. Also, an operation unit control unit 172 is connected to the CPU 171 and is arranged to control a display and a key input with respect to the operation unit 4. An operator perform the key input from the operation unit 4 to instruct the CPU 171 to perform display switching such as an image formation mode, a scanner reading mode, a print output mode, and setting for the sheet information. In accordance with this instruction, the CPU 171 performs the display of a state of the image forming apparatus 1 and the operation mode setting through the key input.

To the CPU 171, an image processing unit 170 arranged to process the signal converted into the electric signal by the image scanning apparatus 95 and an image memory unit 103 arranged to accumulate the processed images are connected. To the image memory unit 103, a reader unit 102 arranged to control the image scanning apparatus 95, a printer unit 176 arranged to control the image forming operation, and an external I/F processing unit 104 are connected.

Also, a wireless IC chip communication control unit 177 is connected to the CPU 171. The wireless IC chip communication control unit 177 is arranged to control a communication with a plurality of wireless IC chips.

Image Memory Unit

Figure 5:
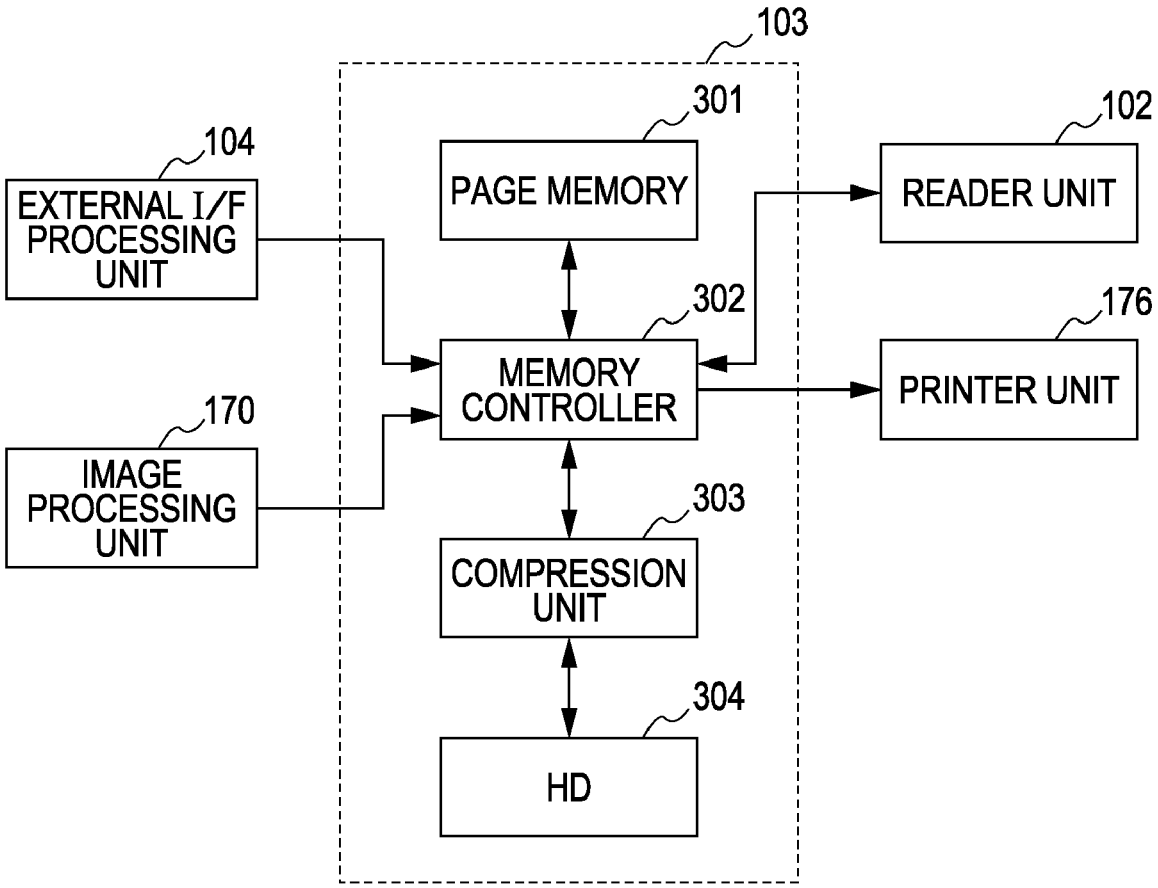
FIG. 5 is a block diagram of an image memory unit of the image forming apparatus.

FIG. 5 is a block diagram of the image memory unit 103. In the image memory unit 103, a memory controller 302 is connected to a page memory 301 composed of a memory such as a DRAM. The memory controller 302 performs transmission and reception of the image data with the external I/F processing unit 104, the image processing unit 170, the reader unit 102, and the printer unit 176.

A compression unit 303 compresses the image data received from the memory controller 302 into a JPG format or the like. The image data compressed by the compression unit 303 is stored in a hard disk drive 304 functioning as a large capacity storage apparatus.

The memory controller 302 generates a DRAM refresh signal of the page memory 301. Also, the memory controller 302 controls accesses to the page memory 301 from the external I/F processing unit 104, the image processing unit 170, and the hard disk drive 304.

Furthermore, while following the instruction from the CPU 171, the memory controller 302 performs controls on a write address to the page memory 301, a read address from the page memory 301, a read direction, and the like. With this configuration, the CPU 171 lays out the plurality of original images on the page memory 301 and controls a function for the output to the printer unit 176, a function of cutting only a part of the images for the output, and an image rotation function.

External I/F Processing Unit

Figure 6:
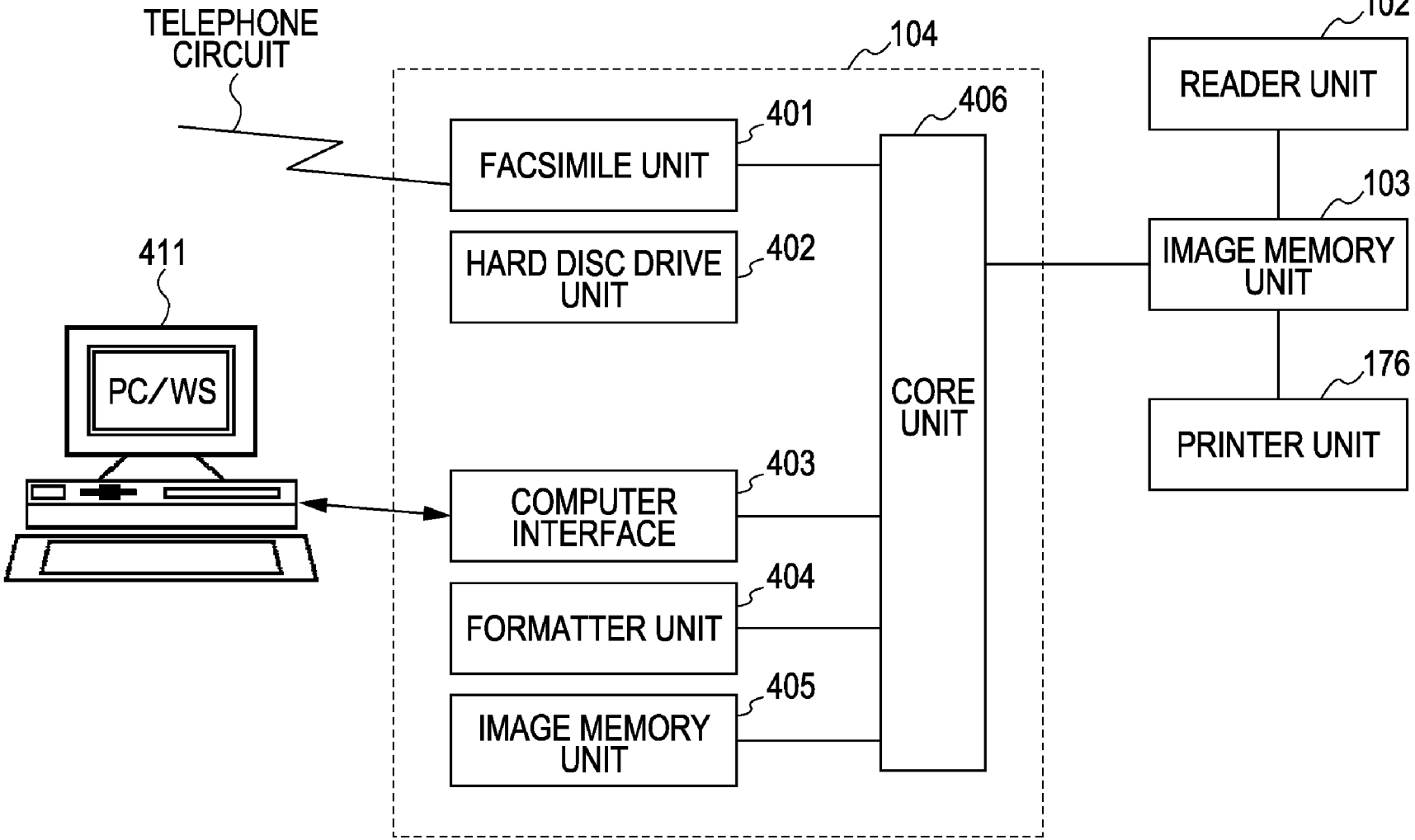
FIG. 6 is a block diagram of an external I/F processing unit of the image forming apparatus.

FIG. 6 is a block diagram of the external I/F processing unit 104. The external I/F processing unit 104 takes in the image data of the reader unit 102 via the image memory unit 103. Also, the external I/F processing unit 104 outputs the image data via the image memory unit 103 to the printer unit 176. The external I/F processing unit 104 includes a core unit 406, a facsimile unit 401, a hard disc drive unit 402, a computer interface 403 connected to an external computer 411, a formatter unit 404, and an image memory unit 405.

The facsimile unit 401 is connected via a modem to a public line and performs reception of facsimile communication data from the public line and transmission of facsimile communication data to the public line. In a case where the facsimile transmission is carried out at a specified time, the facsimile unit 401 saves the image for the facsimile in the hard disc drive unit 402 and performs the processing.

The computer interface 403 is an interface for performing a data communication with an external computer and includes a local area network (hereinafter, referred to as LAN), a serial I/F, an SCSI I/F, Centronics I/F for data input for the printer, and the like. The computer interface 403 notifies the external computer 411 of the states of the printer unit 176 and the reader unit 102 and transfers the image read by the reader unit 102 to the external computer 411 in accordance with the instruction of the external computer 411. Also, the computer interface 403 performs the reception of the print image data from the external computer 411.

The print data notified from the external computer 411 via the computer interface 403 is written in a dedicated use printer code. For this reason, the formatter unit 404 converts the code into raster image data for performing the image formation in the printer unit 176. The formatter unit 404 opens up the raster image data.

The image memory unit 405 is used as the memory for the formatter unit 404 to open up the raster image data, and used for transmitting the image of the reader unit 102 via the computer interface 403 to an external computer.

The core unit 406 controls and manages data transfer among the facsimile unit 401, the computer interface 403, the formatter unit 404, the image memory unit 405, and the image memory unit 103. With this configuration, even when the external I/F processing unit 104 has a plurality of image output units or one image transfer path to the image memory unit 103 exists, under the management of the core unit 406, exclusive access control and priority control are conducted and the image output is performed.

Wireless IC Chip Communication Control Unit

Figure 7:
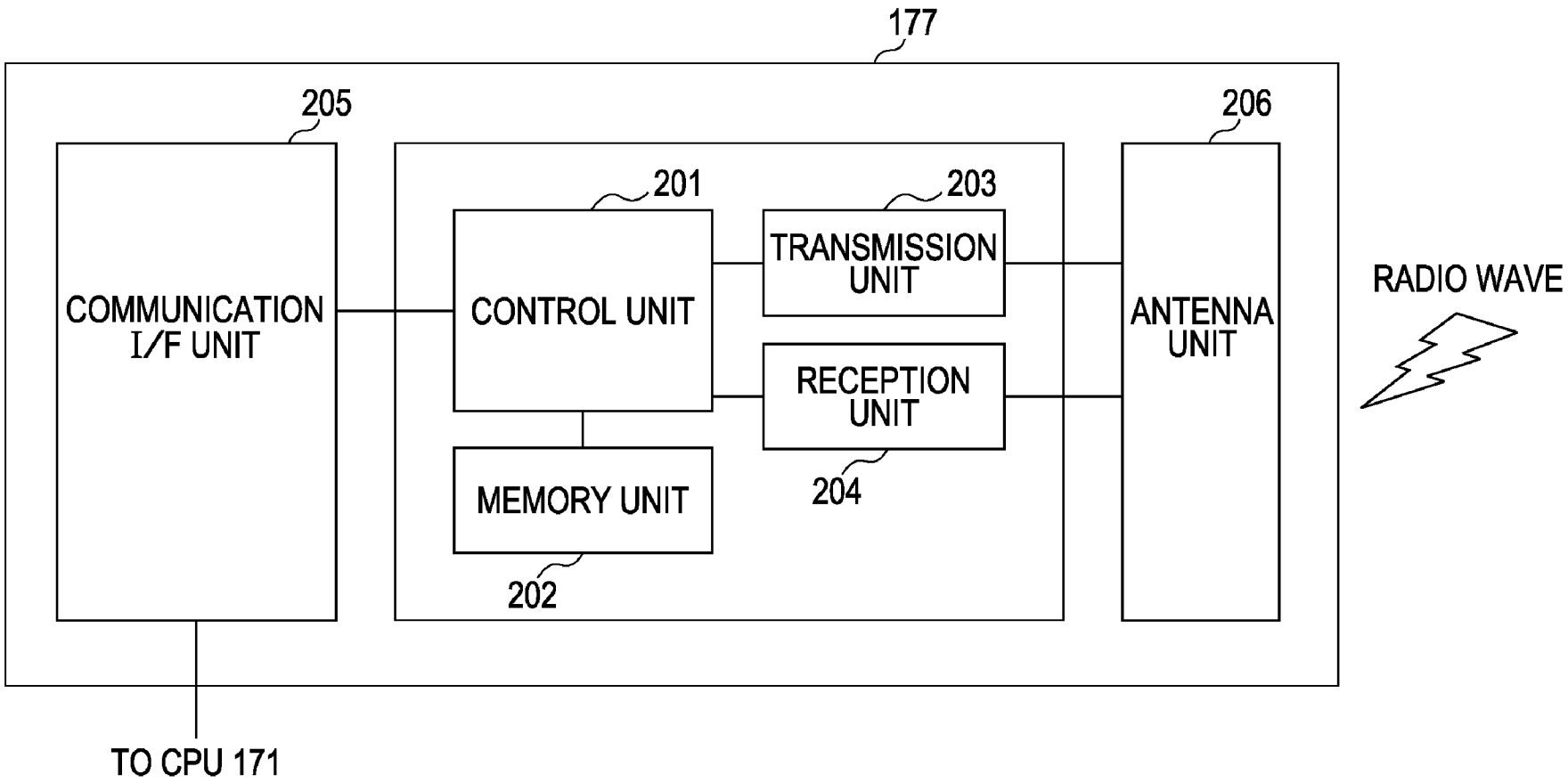
FIG. 7 is a block diagram of a wireless IC chip communication control unit.

FIG. 7 is a block diagram of the wireless IC chip communication control unit 177. The wireless IC chip communication control unit 177 uses radio wave to perform a communication with a wireless IC chip unit 602 mounted to the toner CRG and performs data write and read with the wireless IC chip unit 602 which will be described below. An antenna unit 206 controls the wireless control with the wireless IC chip unit 602 mounted to the toner CRG in response to a transmission request from a transmission unit 203 and a reception request form a reception unit 204.

The transmission unit 203 performs transmission of a control command to the wireless IC chip unit 602 and a data write request to the wireless IC chip unit 602. The reception unit 204 performs a data read request to the wireless IC chip unit 602 and reception of the requested data.

A control unit 201 is arranged to control the entirety of the wireless IC chip communication control unit 177. To be more specific, the control unit 201 performs a control for the communication with the CPU 171, a control for the communication with a plurality of wireless IC chips, and data read and write control with a memory unit 202 composed of a non-volatile memory such as a flash memory. A communication I/F unit 205 performs a control for the communication with the CPU 171.

Wireless IC Chip Unit

Figure 8:
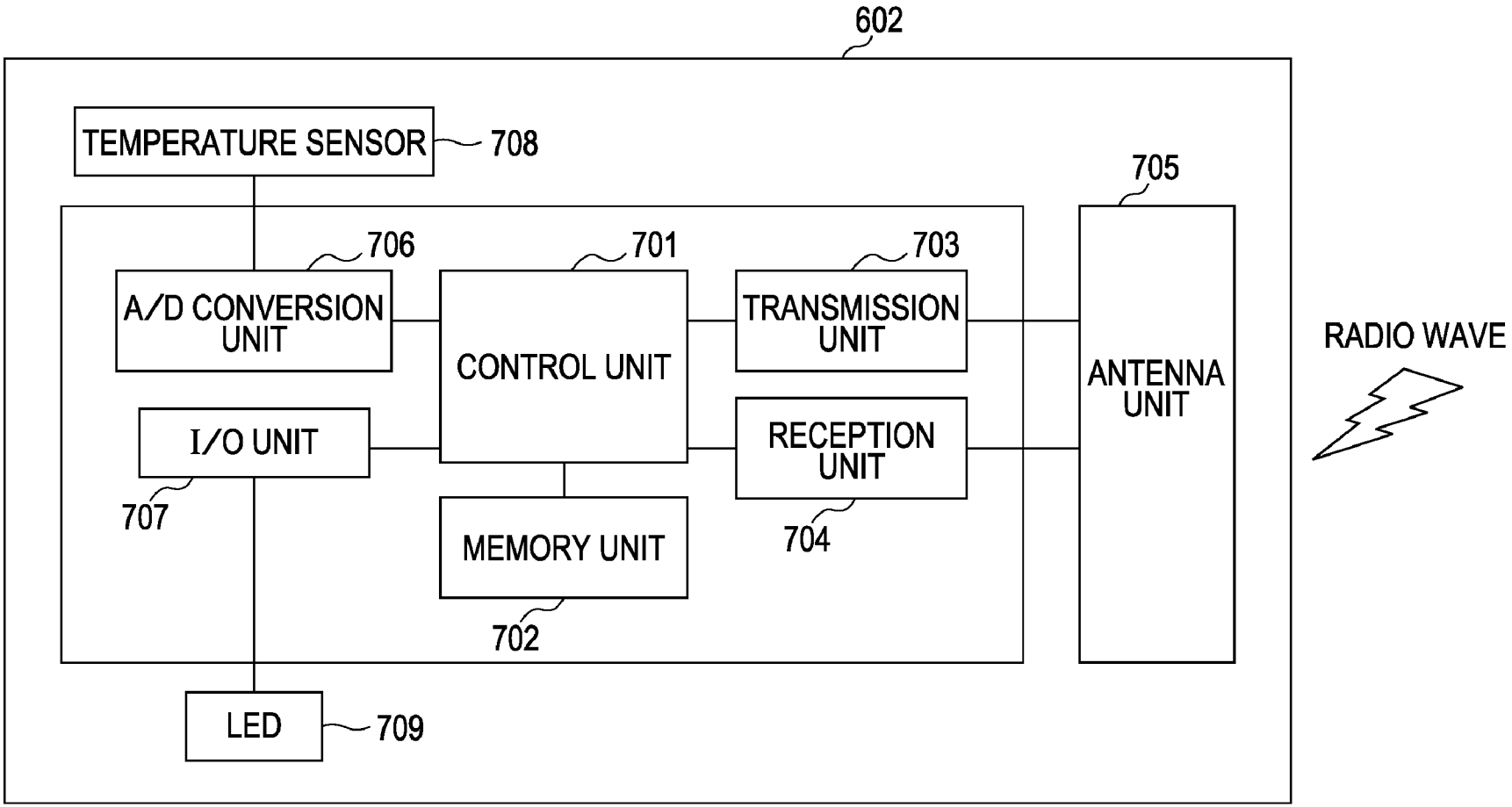
FIG. 8 is a block diagram of a wireless IC chip unit.

FIG. 8 is a block diagram of the wireless IC chip unit. The wireless IC chip unit 602 uses radio wave to performs the communication with the wireless IC chip communication control unit 177 of the image forming apparatus 1.

An antenna unit 705 performs the wireless control with the wireless IC chip communication control unit 177 in response to a transmission request from a transmission unit 703 and a reception request from a reception unit 704. In addition, the antenna unit 705 generates electric power necessary for the wireless IC chip unit 602 to operate from electromagnetic wave energy acquired by the antenna.

The transmission unit 703 performs data transmission to the wireless IC chip communication control unit 177 and command transmission to the wireless IC chip communication control unit 177. The reception unit 704 performs reception of the commands including the data read request from the wireless IC chip communication control unit 177 and the data write request.

A control unit 701 is arranged to control the entirety of the wireless IC chip unit 602. To be more specific, the control unit 701 performs a control for the communication with the wireless IC chip communication control unit 177 and read and write control to a memory unit 702 composed of a non-volatile memory such as a flash memory. Also, the control unit 701 performs write/read control on the temperature data to the memory unit 702 to perform LED turning ON/OFF control.

An A/D conversion unit 706 is connected to a temperature sensor 708 functioning as a second temperature detection unit. As the /D conversion unit 706 converts the temperature information into digital data, it is possible to measure the temperature in the control unit 701. An I/O unit 707 is provided with a function of performing input and output controls at the port. In the I/O unit 707, a LED 709 is connected to the output port, and in accordance with a command from the wireless IC chip communication control unit 177, the control unit 701 controls turning ON and OFF of the LED 709.

Operation Unit

Figure 9:
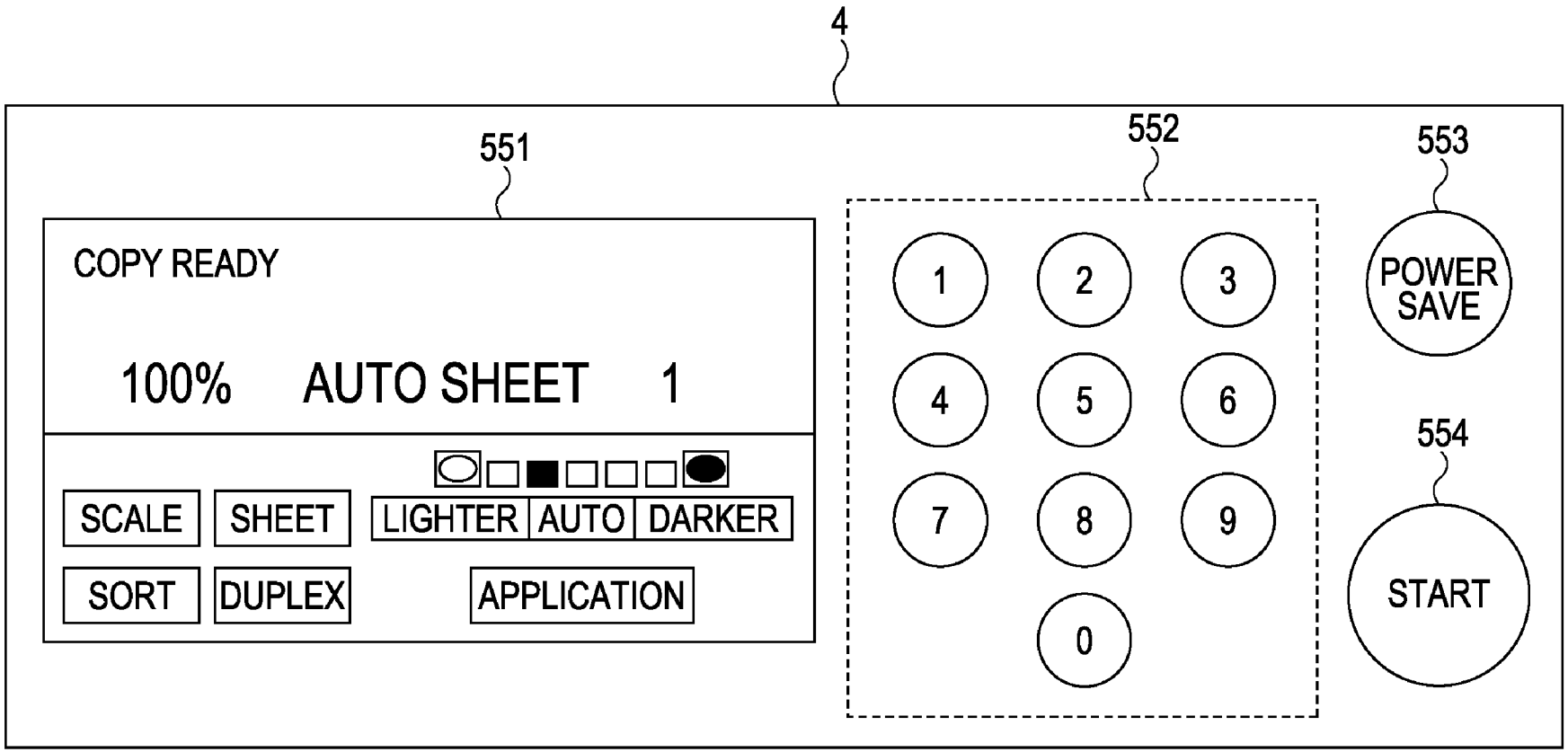
FIG. 9 illustrates an operation unit provided to the image forming apparatus.

FIG. 9 illustrates the operation unit 4 provided to the image forming apparatus 1. An operation unit screen 551 is arranged to display various pieces of information related to the copy functions. Numeral keys 552 are mainly used for setting the number of sheets to be copied. A power save key 553 is a key to be pressed in a case when a power save state is desired in a normal state and the power save state is desired to be shifted to the normal state. The power save key 553 is usually turned OFF, and in a state of the power save, the power save key 553 is turned ON in green. A start key 554 is pressed when the user performs copying.

Data Structure

FIG. 10 illustrates an example of a data structure stored the memory unit 702 of the wireless IC chip unit 602 which is arranged in the toner CRG. The memory unit 702 stores data pieces such as a chip ID, product type data, toner type data, production date data, print count data, remaining amount data, status data, and use starting date data as a data structure table.

The chip ID is data for identifying the wireless IC chip. The product type data is data for indicating which product the toner CRG deals with. For example, when the toner CRG is for a product A, data corresponding to the product A is stored in the memory unit 702, and when the toner CRG is for a product B, data corresponding to the product B is stored in the memory unit 702.

The toner type data is data for indicating a type of toner stored in the toner CRG. For example, 01: K toner (black), 02: Y toner (yellow), 03: M toner (magenta), and 04: C toner (cyan) are indicated. The production date data is data for indicating a production date of the toner CRG.

The print count data is data indicating the number of times for performing replenishment for the print after the toner CRG is set to the main body. For example, in the case of the new product, 0 is stored in the memory unit 702. When the toner CRG is set to the main body, count up is performed by the number of times for performing the toner replenishment for the print to update the print count data. With this configuration, even when the toner CRG is replaced in a middle course, the replenishment time data of the toner CRG is remained in the toner CRG.

The remaining amount data is used for determining whether the replacement of the toner CRG is necessary as compared with the print count data. The status data indicates the state of the toner CRG, and 00: new product state, 01: main body set in use state, 02: main body unset in use state, 03: used state, and 04: use incapable state are indicated. In a state where the toner CRG is shipped from a factory, the status data indicates 00: new product state, and in a case where the toner CRG is mounted to the main body and the print count data is updated, the status data indicates 01: main body set in use state. In a case where the remaining amount data<print counter is established, the status data indicates 03: used state. In a case where the temperature of the toner CRG is equal to or higher than a predetermined temperature, the status data indicates 04: use incapable state.

The data on the number of the temperature sensors indicates the number of the temperature sensors mounted to the wireless IC chip unit 602, indicating that 0: no temperature sensor exists and 1 or more: the temperature sensor exists.

Figure 11:
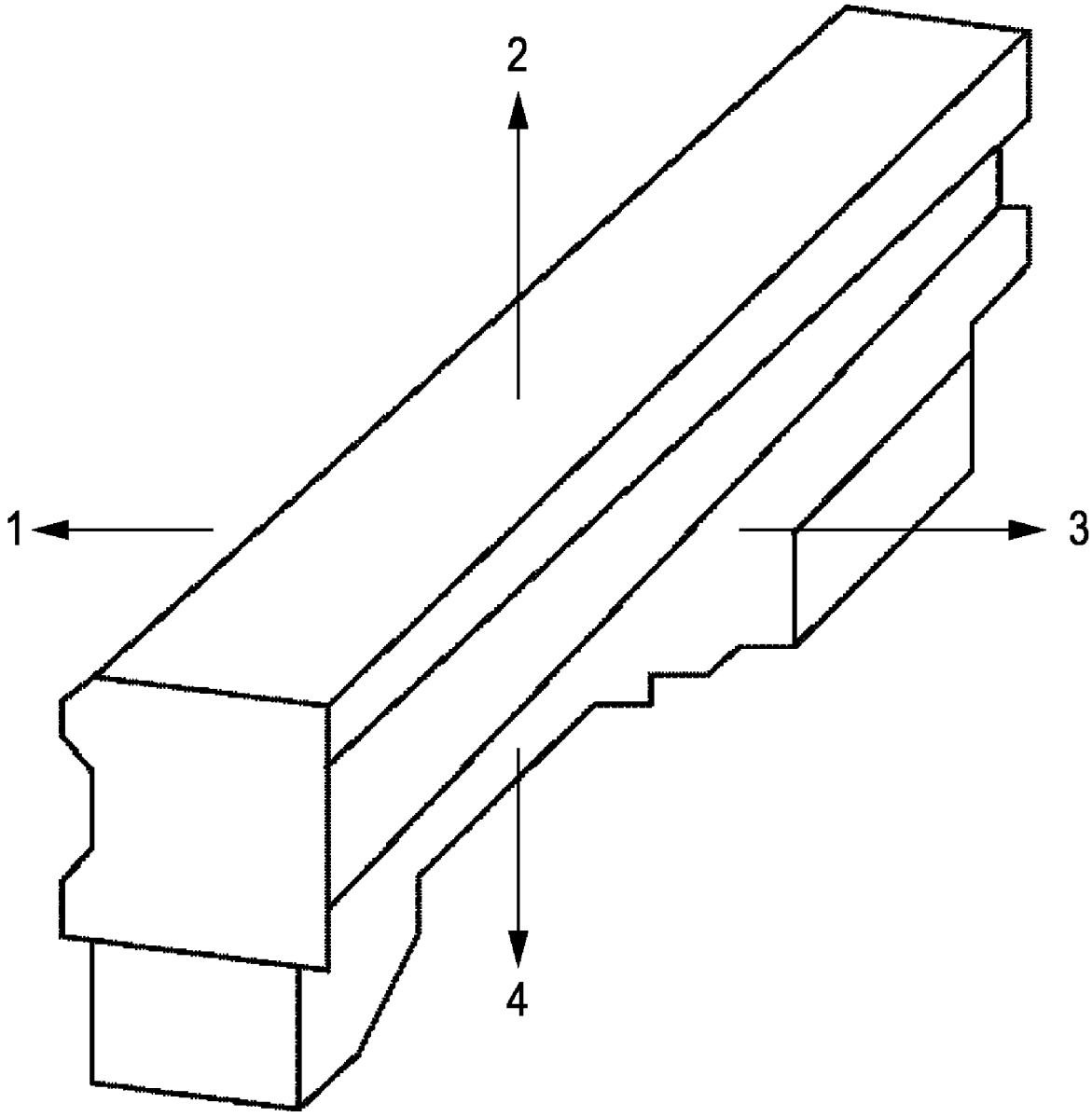
FIG. 11 is an explanatory diagram of data indicating on which face of a toner CRG a temperature sensor is arranged.

Arrangement data 1 is data indicating which face of the toner CRG the wireless IC chip unit 602 is attached on, and as illustrated in FIG. 11, the data indicates 1: left side face, 2: upper face, 3: right side face, and 4 lower face with respect to the image forming apparatus 1. Also, arrangement data 2 is data indicating at which position of the toner CRG the wireless IC chip unit 602 is arranged. Herein, by setting the near side as the reference when the toner CRG is set to the image forming apparatus 1, the data is indicated in unit of 1 mm.

Figure 12:
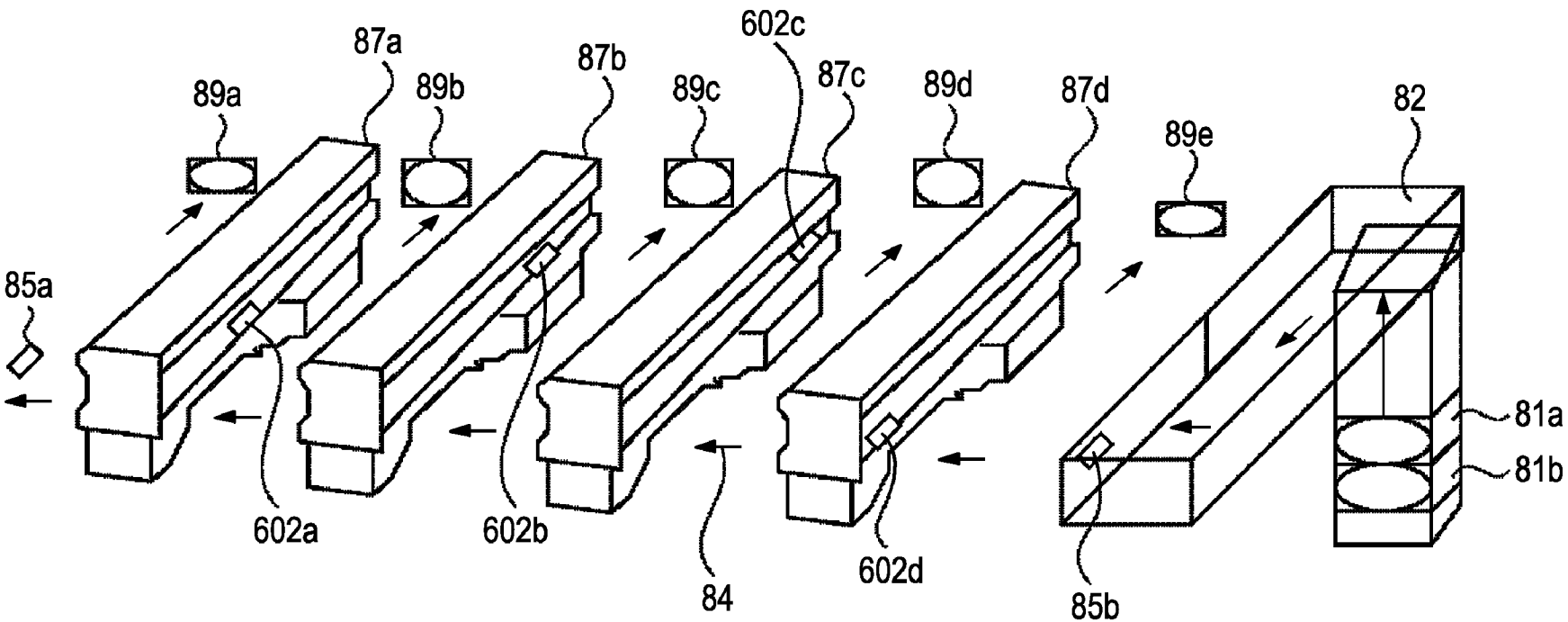
FIG. 12 is an explanatory diagram of an arrangement example of the temperature sensors provided to the wireless IC chip units of the toner CRGs.

FIG. 12 illustrates the arrangement of the wireless IC chip unit 602, but in this case, 602*a* to *d* of the arrangement data 1 all indicate 3, 602*a* of the arrangement data 2 indicates 200, 602*b* of the arrangement data 2 indicates 350, and 602*c* of the arrangement data 2 indicates 550, 602*d* of the arrangement data 2 indicates 50.

Temperature data 1 is the temperature data measured this time, temperature data 2 is the temperature data measured last time, and temperature data 3 is the temperature data measured time before last. Also, temperature data MAX indicate the maximum measured temperature since start of the measurement, and temperature data MIN indicate the minimum measured temperature since the start of the measurement. It is noted that herein, the description has been provided only of the temperature sensor, but a temperature/humidity sensor may also be used.

Toner Cartridge Monitoring Operation

Figures 13, 14:
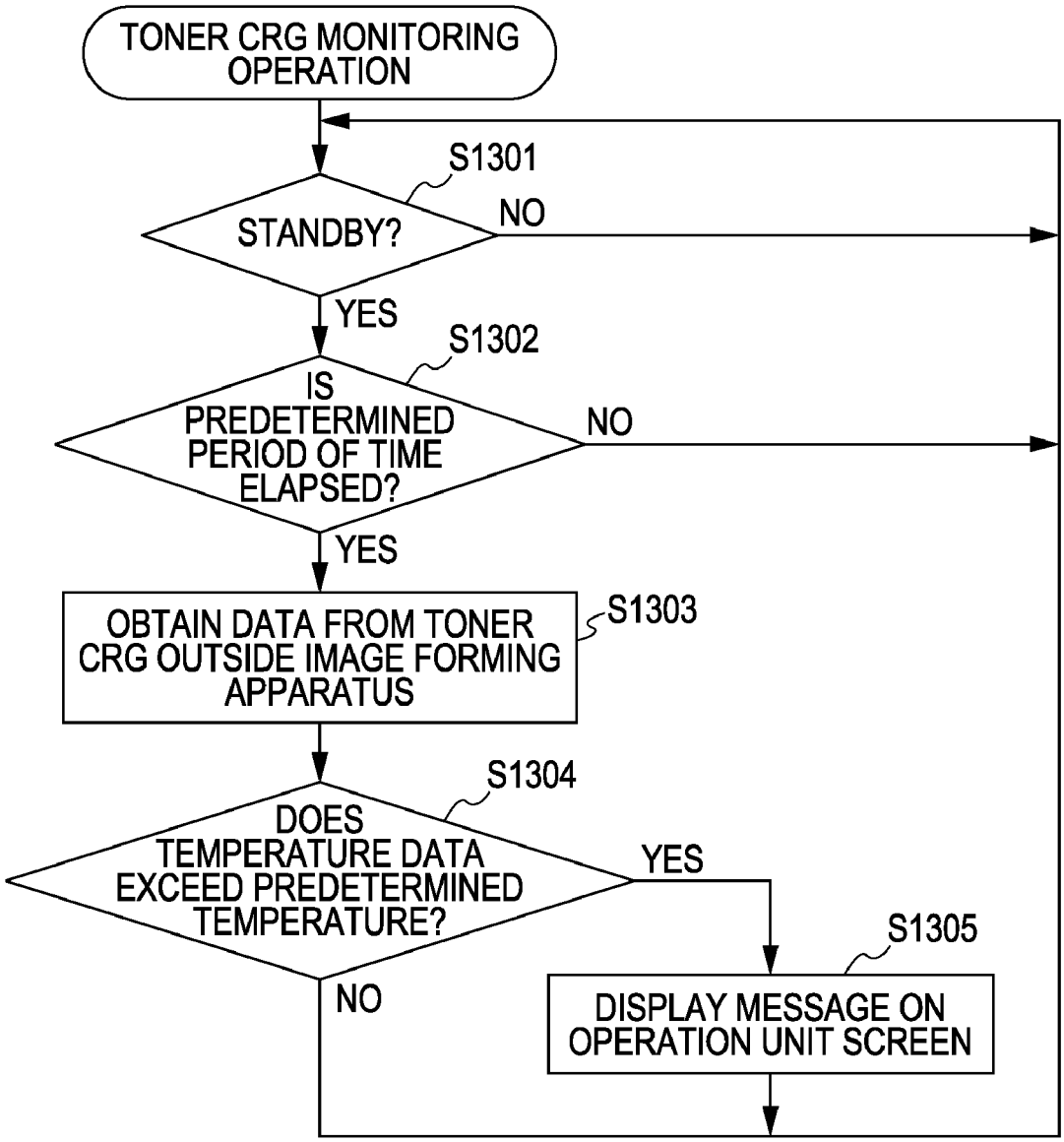
FIG. 13 is a flowchart for describing a monitoring operation of the toner CRG provided outside the image forming apparatus.
FIG. 14 illustrates a message example displayed on the operation unit in a case where the temperature of the storage container for the toner CRG is too high.

FIG. 13 is a flowchart for a monitoring operation on the toner CRG outside the image forming apparatus. A program for executing this flowchart is stored in the ROM 174 and executed by the CPU 171.

The CPU 171 determines whether the image forming operation is not performed, that is, determines whether the state is a standby state (S1301). In step 1301, in a case where it is determined that the state is the standby state, the CPU 171 determines whether a predetermined period of time has elapsed since the previously performed temperature detection operation on the toner CRG outside the image forming apparatus (S1302). Herein, the predetermined period of time is set as 5 minutes.

In step S1302, in a case where the CPU 171 determines that the predetermined period of time has elapsed, a communication is performed with the communicable toner CRG outside the image forming apparatus to obtain data from the toner CRG including the temperature data (S1303).

Next, the CPU 171 determines whether from the obtained data of the respective toner CRGs, first, the chip ID is valid, then, product identification data is valid, and the temperature sensor exists, for example. In a case where no problem occurs in all the data, the CPU 171 determines whether the temperature data exceeds a predetermined temperature (S1304).

In step S1304, in a case where the CPU 171 determines that the temperature data exceeds the predetermined temperature, a message that the temperature is high is displayed on the operation unit screen 551 of the operation unit 4 as illustrated in FIG. 14 to notify the user (S1305). With this notification, as the user can check that the temperature in the storage container of the toner CRG is too high, it is possible for the user to take a measure for decreasing the temperature in the toner storage container before the toner inside the toner CRG is condensed, for example.

Toner Cartridge Replacement Operation

Figure 15:
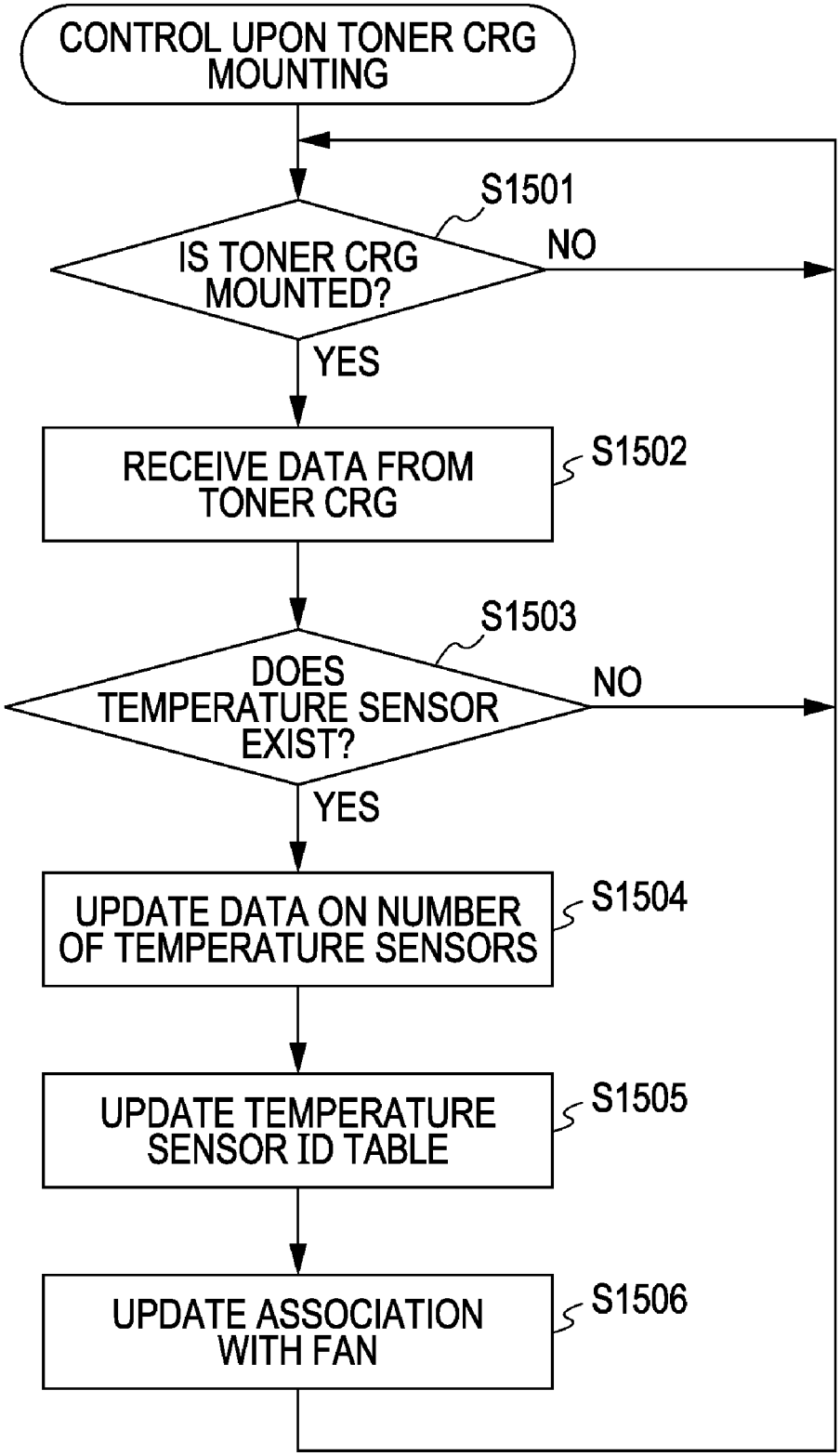
FIG. 15 is a flowchart for describing a control in a case where the toner CRG is mounted to the image forming apparatus.

FIG. 15 is a flowchart for describing a control in a case where the toner CRG is mounted to the image forming apparatus 1. A program for executing this flowchart is stored in the ROM 174 and executed by the CPU 171.

In a case where a front cover of the image forming apparatus 1 is opened, the CPU 171 can detect whether the toner cartridge is mounted or not mounted by using the toner CRG set detection sensor 15. The detection of the mounting of the toner cartridge is performed by the toner CRG set detection sensors 15*a* to 15*d* respectively provided to the toner CRGs of YMCK.

First, the CPU 171 determines whether the toner CRG is mounted to the image forming apparatus 1 by using the toner CRG set detection sensor 15 (S1501). In step S1501, in a case where it is determined that the toner CRG is mounted, the CPU 171 controls the wireless IC chip communication control unit 177 to perform a communication with the wireless IC chip unit 602 of toner CRG 87 which is mounted to the image forming apparatus 1. Then, the CPU 171 receives data illustrated in FIG. 10 which is stored in the memory unit 702 of the wireless IC chip unit 602 (S1502). Next, on the basis of the received data, the CPU 171 determines whether the toner CRG 87 determined to be mounted to the image forming apparatus 1 has the temperature sensor (S1503).

FIG. 16 illustrates a data table example for storing the data of the temperature sensor existing in the image forming apparatus. This data table has the data on the number of the temperature sensors existing in the image forming apparatus and a temperature sensor table ID assigned to each of the temperature sensor tables. The data table is stored in the RAM 175.

Also, for each of the temperature sensor table IDs, arrangement position data (0: the inside of the image forming apparatus, 1: the toner CRG of Y color, 2: the toner CRG of M color, 3: the toner CRG of C color, and 4: the toner CRG of K color) is stored in the RAM 175. Also, for each of the temperature sensor table IDs, arrangement detail data is stored in the RAM 175. The arrangement detail data is port data which is I/O data in the case of the inside of the image forming apparatus and Bit data. On the other hand, the arrangement detail data is the arrangement data 1 (arrangement face) and the arrangement data 2 (arrangement position) in the case of the toner CRG.

In step S1503, in a case where the CPU 171 determines that the toner CRG 87 has the temperature sensor, the CPU 171 updates the data on the number of temperature sensors in the data table of FIG. 16 (S1504).

Next, the CPU 171 updates the temperature sensor table ID in the temperature sensor table (S1505). Hereinafter, as an example, a description will be provided of a case where the K (black) CRG of the toner CRG is set, and it is determined that the K (black) CRG has the temperature sensor.

In the data in the temperature sensor table of FIG. 16, before the K (black) CRG of the toner CRG is set, the number of temperature sensors is 5, and data is set in the temperature sensor table IDs 1 to 5. In a case where the K (black) CRG of the toner CRG is set, the CPU 171 determines that the K (black) CRG has one temperature sensor, and updates the number of temperature sensors in the temperature sensor table to 6. Also, the CPU 171 assigns 6 which is the smallest ID where data in the temperature sensor table ID is not set to the temperature sensor of the K (black) CRG. Then, on the basis of the data stored in the memory unit 702 of the wireless IC chip unit 602, the CPU 171 stores the arrangement position data (4: KCRG) and the arrangement detail data (3: the arrangement data 1, 50: the arrangement data 2) in the RAM 175.

Next, on the basis of the arrangement position data of the temperature sensor and the arrangement detail data, the CPU 171 associates with the fan existing in the image forming apparatus to update the data table illustrated in FIG. 17 (S1506). The data table illustrated in FIG. 17 is a table indicating the number of temperature sensors associates with the fan and the temperature sensor table ID of the temperature sensor associates with the fan. This data table exists for each fan in the image forming apparatus, and is stored in the RAM 175 as information indicating a corresponding relation between the respective fans and the temperature sensors. It is noted that step S1506 will be described below by using FIG. 19.

Figure 18:
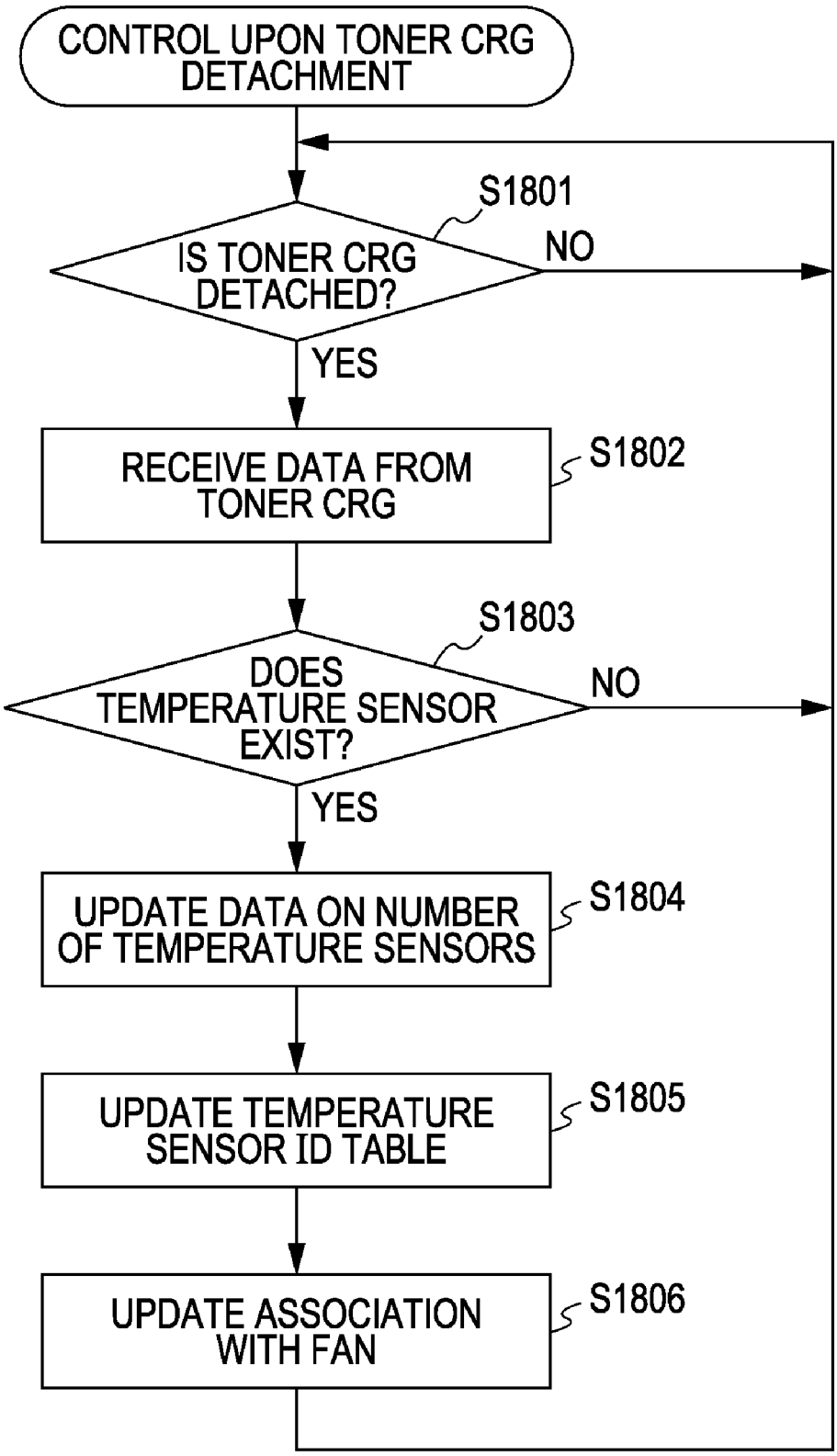
FIG. 18 is a flowchart for describing a control in a case where the toner CRG is detached from the image forming apparatus.

FIG. 18 is a flowchart for describing a control in a case where the toner CRG is detached from the image forming apparatus 1. A program for executing this flowchart is stored in the ROM 174 and executed by the CPU 171.

First, the CPU 171 determines whether the toner CRG is detached the image forming apparatus 1 by using the toner CRG set detection sensor 15 (S1801). In step S1801, in a case where it is determined that the toner CRG is detached, the CPU 171 controls the wireless IC chip communication control unit 177 to communicate with the wireless IC chip unit 602 of the toner CRG 87 which is detached from the image forming apparatus 1. Then, the CPU 171 receives data stored in the memory unit 702 of the wireless IC chip unit 602 as illustrated in FIG. 10 (S1802).

Next, on the basis of the received data, the CPU 171 determines whether the toner CRG 87 determined to be detached from the image forming apparatus 1 has the temperature sensor (S1803).

In step S1803, in a case where the CPU 171 determines that the toner CRG 87 has the temperature sensor, the CPU 171 updates the data on the number of temperature sensors in the data table of FIG. 16 (S1804).

Next, the CPU 171 updates the temperature sensor table ID in the temperature sensor table (S1805). Hereinafter, as an example, a description will be provided of a case where the K (black) CRG of the toner CRG is set and detached, and it is determined that the K (black) CRG has the temperature sensor.

According to data in the temperature sensor table of FIG. 16, before the K (black) CRG of the toner CRG is detached, the number of the temperature sensors is 6 and data is set for the temperature sensor table IDs from 1 to 6.

In a case where the K (black) CRG of the toner CRG is detached, the CPU 171 determines that the K (black) CRG has one temperature sensor and updates the number of the temperature sensors in the temperature sensor table to 5. Also, the CPU 171 searches the temperature sensor arrangement position data of the temperature sensor table ID (4: KCRG) for the temperature sensor table ID (6: ID) which is assigned to the temperature sensor arranged in the K (black) CRG. Then, the CPU 171 clears the data of the temperature sensor table ID (6) and sets the temperature sensor table ID (6) as unused.

Next, on the basis of the temperature sensor arrangement position data and the arrangement detail data, association with the fan existing in the image forming apparatus is established, and the temperature sensor table illustrated in the FIG. 17 is updated (S1806). To be more specific, the CPU 171 searches the temperature sensor table of FIG. 17 for data matching with the temperature sensor ID corresponding to the temperature sensor which is provided to the toner CRG detached from the image forming apparatus. When the matching data exists, the CPU 171 clears the temperature sensor ID set in the data table and also updates the number of associated temperature sensors. In the case of the above-described example, as the data of the temperature sensor ID (2) is 6 and matched with the temperature sensor table ID (6: ID), the CPU 171 updates the associated temperature sensor number data to 1 and clears the data of the temperature sensor ID (2).

Figure 19:
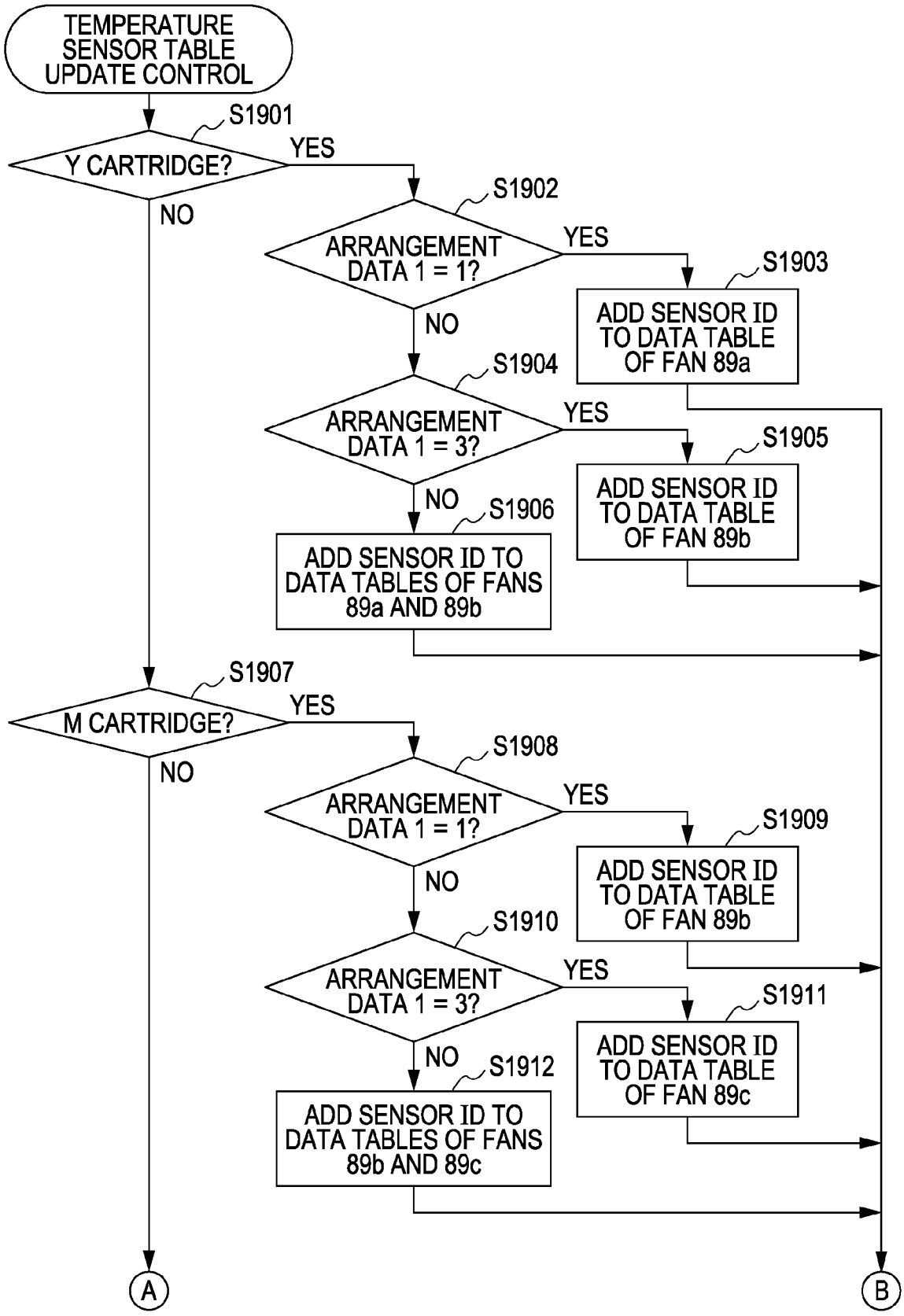
FIG. 19 is a flowchart for describing an updating control on a temperature sensor table.
Figure 20:
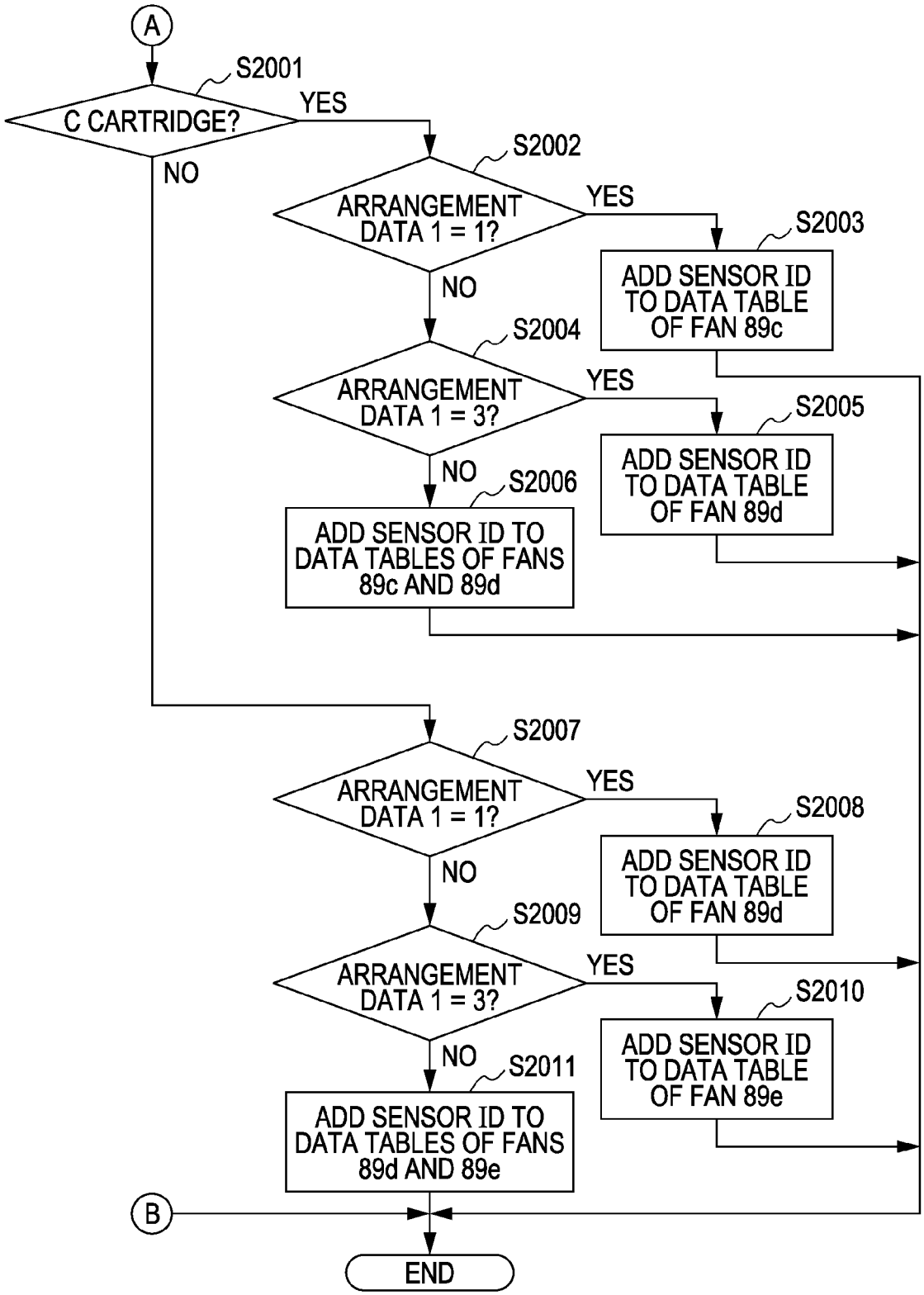
FIG. 20 is a flowchart for describing the updating control on the temperature sensor table.

FIGS. 19 and 20 are flowcharts for describing an updating control on the temperature sensor table illustrated in FIG. 17. The flowcharts describe a detail of the control in step S1506 of FIG. 15. A program for executing the flowcharts is stored in the ROM 174 and executed by the CPU 171.

First, the CPU 171 refers to the toner type data from the data received in step S1502 to determine whether the toner CRG 87 mounted to the image forming apparatus 1 is the Y (yellow) cartridge (S1901). In step S1901, in a case where it is determined that the toner CRG 87 is the Y cartridge, the CPU 171 refers to the arrangement data 1 from the data received in step S1502. Then, the CPU 171 determines whether the temperature sensor is arranged on the left side face, that is, determines whether the arrangement data 1 is 1 (S1902).

In a case where it is determined that the temperature sensor is arranged on the left side face, that is, the arrangement data 1 is 1, the CPU 171 adds the associated temperature sensor number data and the temperature sensor ID in the temperature sensor table of the exhaust air fan 89*a* and updates the table (S1903).

In step S1902, in a case where it is determined that the arrangement data 1 is not 1, the CPU 171 determines whether the temperature sensor is arranged on the right side face, that is, determines whether the arrangement data 1 is 3 (S1904). In a case where it is determined that the temperature sensor is arranged on the right side face, that is, the arrangement data 1 is 3, the CPU 171 adds the associated temperature sensor number data and the temperature sensor ID in the temperature sensor table of the exhaust air fan 89*b* and updates the table (S1905).

In step S1904, in a case where it is determined that the arrangement data 1 is not 3, the temperature sensor is arranged on the upper face or lower face of the toner CRG. Therefore, the CPU 171 adds the associated temperature sensor number data and the temperature sensor ID in the temperature sensor tables of the exhaust air fans 89*a* and 89*b* and updates the tables (S1906).

Also, in step S1901, in a case where it is determined that the toner CRG 87 mounted to the image forming apparatus 1 is not the Y cartridge, the CPU 171 refers to the toner type data from the data received in step S1502. Then, the CPU 171 determines whether the toner CRG 87 mounted to the image forming apparatus 1 is the M (magenta) cartridge (S1901).

In step S1907, in a case where it is determined that the toner CRG 87 is the M cartridge, the CPU 171 refers to the arrangement data 1 from the data received in step S1502. Then, the CPU 171 determines whether the temperature sensor is arranged on the left side face, that is, determines whether the arrangement data 1 is 1 (S1908).

In a case where it is determined that the temperature sensor is arranged on the left side face, that is, the arrangement data 1 is 1, the CPU 171 adds the associated temperature sensor number data and the temperature sensor ID in the temperature sensor table of the exhaust air fan 89*b* and updates the table (S1909).

In step S1908, in a case where it is determined that the arrangement data 1 is not 1, the CPU 171 determines whether the temperature sensor is arranged on the right side face, that is, determines whether the arrangement data 1 is 3 (S1910). In a case where it is determined that the temperature sensor is arranged on the right side face, that is, the arrangement data 1 is 3, the CPU 171 adds the associated temperature sensor number data and the temperature sensor ID in the temperature sensor table of the exhaust air fan 89*c* and updates the table (S1911).

In step S1910, in a case where it is determined that the arrangement data 1 is not 3, the temperature sensor is arranged on the upper face of the lower face of the toner CRG. Therefore, the CPU 171 adds the associated temperature sensor number data and the temperature sensor ID in the temperature sensor tables of the exhaust air fans 89*b* and 89*c* and updates the tables (S1912).

Also, in step S1907, in a case where it is determined that the toner CRG 87 mounted to the image forming apparatus 1 is not the M cartridge, the CPU 171 refers to the toner type data from the data received in step S1502. Then, the CPU 171 determines whether the toner CRG 87 mounted to the image forming apparatus 1 is the C (cyan) cartridge (S2001).

In step S2001, in a case where it is determined that the toner CRG 87 is the C cartridge, the CPU 171 refers to the arrangement data 1 from the data received in step S1502. Then, the CPU 171 determines whether the temperature sensor is arranged on the left side face, that is, determines whether the arrangement data 1 is 1 (S2002).

In a case where it is determined that the temperature sensor is arranged on the left side face, that is, the arrangement data 1 is 1, the CPU 171 adds the associated temperature sensor number data and the temperature sensor ID in the temperature sensor table of the exhaust air fan 89*c* and updates the table (S2003).

In step S2002, in a case where it is determined that the arrangement data 1 is not 1, the CPU 171 determines whether the temperature sensor is arranged on the right side face, that is, determines whether the arrangement data 1 is 3 (S2004). In a case where it is determined that the temperature sensor is arranged on the right side face, that is, the arrangement data 1 is 3, the CPU 171 adds the associated temperature sensor number data and the temperature sensor ID in the temperature sensor table of the exhaust air fan 89*d* and updates the table (S2005).

In step S2004, in a case where it is determined that the arrangement data 1 is not 3, the temperature sensor is arranged on the upper face or the lower face of the toner CRG. Therefore, the CPU 171 adds the associated temperature sensor number data and the temperature sensor ID in the temperature sensor tables of the exhaust air fans 89*c* and 89*d* and updates the table (S2006).

Also, in step S2001, in a case where it is determined that the toner CRG 87 mounted to the image forming apparatus 1 is not the C cartridge, the toner CRG 87 mounted to the image forming apparatus 1 is the K (black) cartridge. In this case, the CPU 171 refers to the arrangement data 1 from the data received in step S1502. Then, the CPU 171 determines whether the temperature sensor is arranged on the left side face, that is, determines whether the arrangement data 1 is 1 (S2007).

In a case where it is determined that the temperature sensor is arranged on the left side face, that is, the arrangement data 1 is 1, the CPU 171 adds the associated temperature sensor number data and the temperature sensor ID in the temperature sensor table of the exhaust air fan 89*d* and updates the tables (S2008).

In step S2007, in a case where it is determined that the arrangement data 1 is not 1, the CPU 171 determines whether the temperature sensor is arranged on the right side face, that is, determines whether the arrangement data 1 is 3 (S2009). In a case where it is determined that the temperature sensor is arranged on the right side face, that is, the arrangement data 1 is 3, the CPU 171 adds the associated temperature sensor number data and the temperature sensor ID in the temperature sensor table of the exhaust air fan 89*e* and updates the table (S2010).

In step S2009, in a case where it is determined that the arrangement data 1 is not 3, the temperature sensor is arranged on the upper face or the lower face of the toner CRG. Therefore, the CPU 171 adds the associated temperature sensor number data and the temperature sensor ID in the temperature sensor tables of the exhaust air fans 89*d* and 89*e* and updates the tables (S2011).

Supply Air Fan Rotation Control

Figure 21:
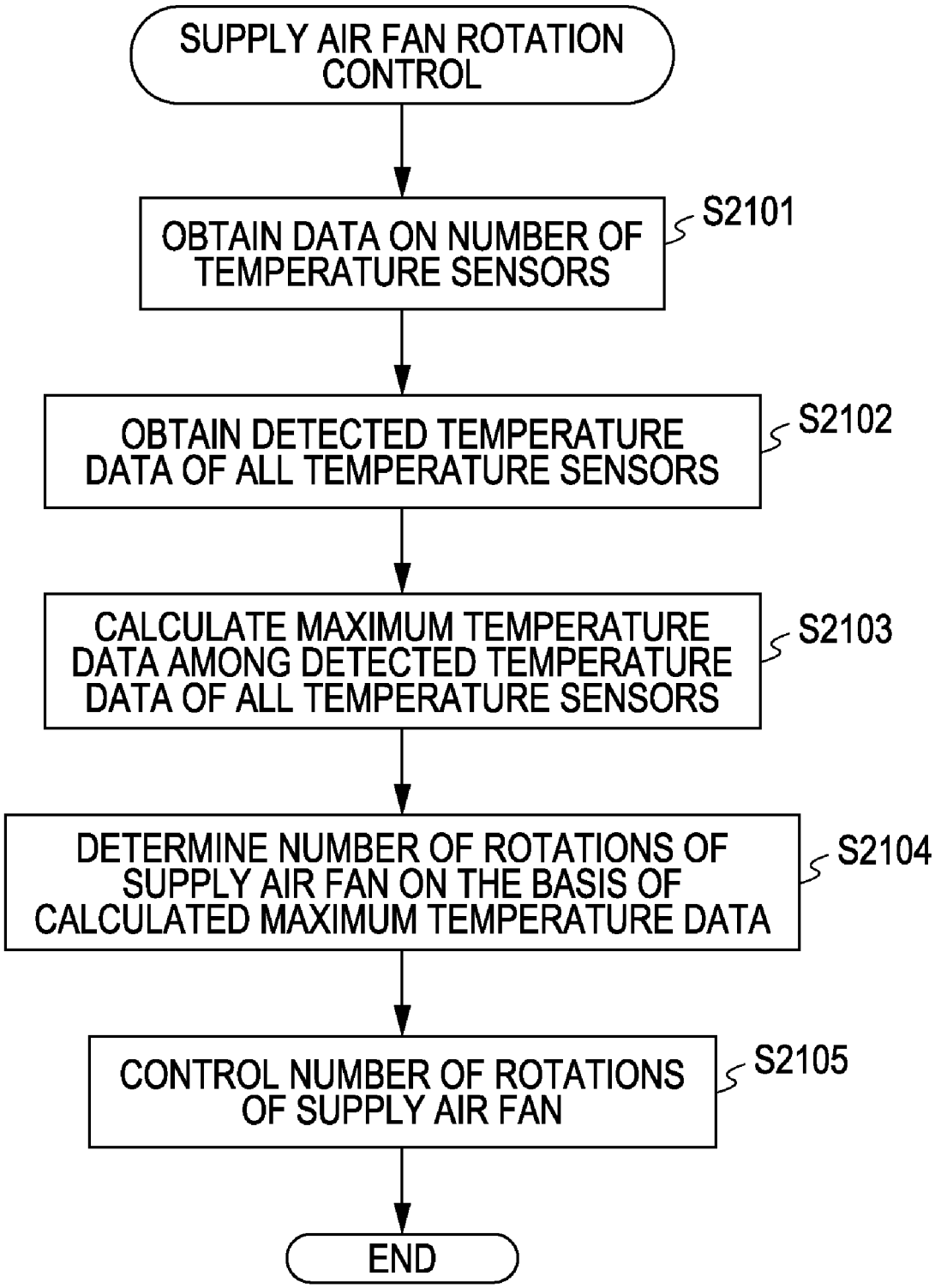
FIG. 21 is a flowchart for describing a rotation control of a supply air fan.

FIG. 21 is a flowchart for describing a rotation control of the supply air fan. A program for executing this flowchart is stored in the ROM 174 and executed by the CPU 171. The CPU 171 executes the supply air fan rotation control at every predetermined period of time. Herein, the predetermined period of time is regulated as 10 seconds.

The CPU 171 obtains the data on the number of the temperature sensors from the RAM 175 (S2101). Then, the CPU 171 obtains the detected temperature data of all the temperature sensors, that is, the temperature sensors arranged in the image forming apparatus and the temperature sensors provided to the toner CRG and stores the data in the RAM 175 (S2102). The CPU 171 calculates the maximum temperature data among the obtained detected temperature data of the temperature sensors (S2103).

The CPU 171 determines the target number of rotations of the fan corresponding to the calculated maximum temperature data (S2104). Herein, the target number of rotations of the fan is regulated for each fan, and table data of the temperature and the target number of the rotations for each fan as illustrated in FIG. 3 is stored in the ROM 174. The CPU 171 performs the control so that the numbers of rotations of the supply air fans 81*a* and 81*b* are set as the numbers of rotations determined in step S2104 (S2105).

Exhaust Air Fan Rotation Control

Figure 22:
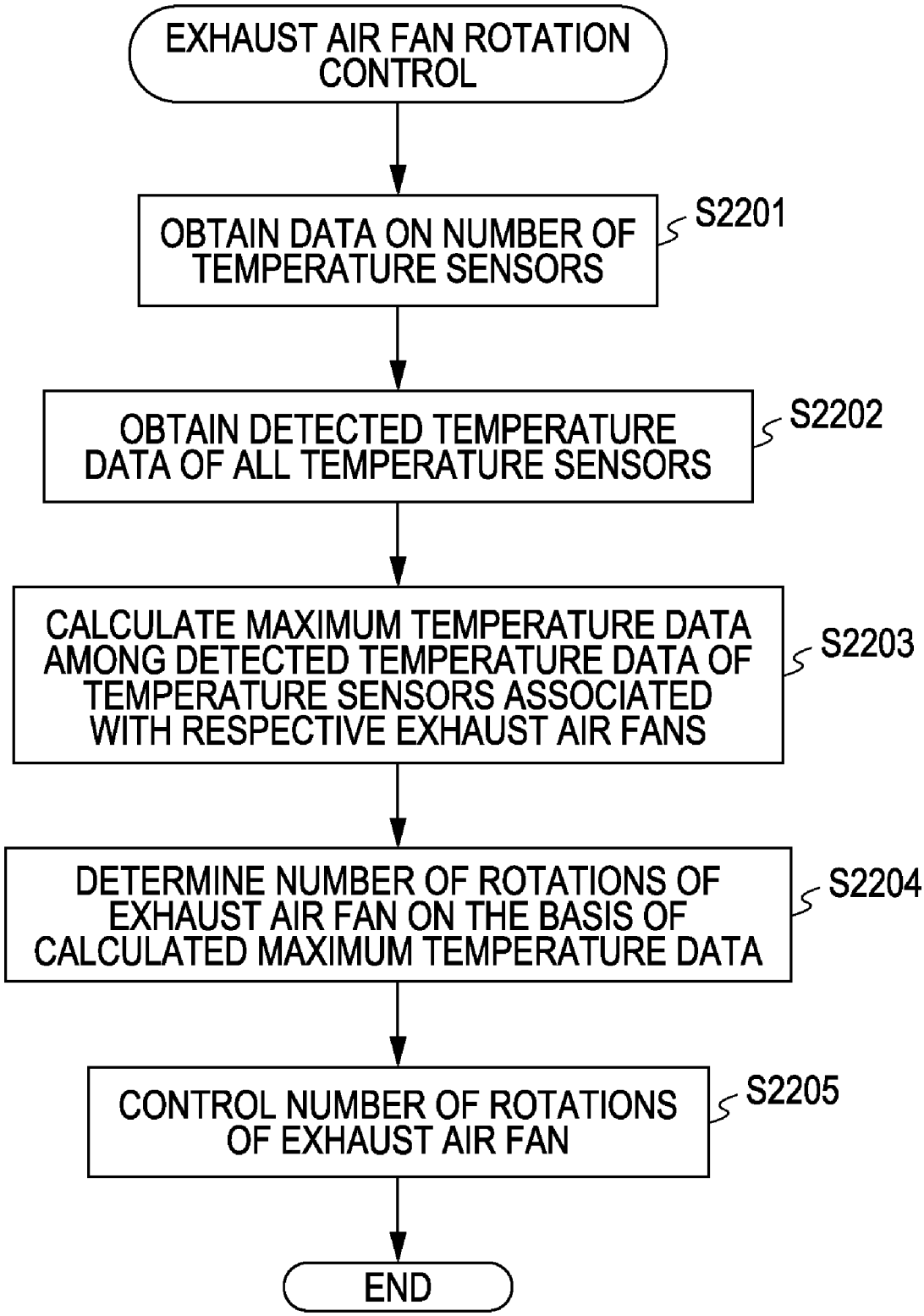
FIG. 22 is a flowchart for describing a rotation control of an exhaust air fan.

FIG. 22 is a flowchart for describing a rotation control for the exhaust air fan. A program for executing this flowchart is stored in the ROM 174 and executed by the CPU 171. The CPU 171 executes the exhaust air fan rotation control for every predetermined period of time. Herein, the predetermined period of time is regulated as 10 seconds.

The CPU 171 obtains the data on the number of the temperature sensors from the RAM 175 (S2201). Then, the CPU 171 obtains the detected temperature data of all the temperature sensors, that is, the temperature sensors arranged in the image forming apparatus and the temperature sensors provided to the toner CRG and stores the data in the RAM 175 (S2202). The CPU 171 calculates the maximum temperature data which is the highest temperature among the detected temperature data of the temperature sensors associated with the respective exhaust air fans (S2203).

The CPU 171 determines the target number of rotations of the fan corresponding to the maximum temperature data calculated for each fan (S2204). Herein, the target number of rotations of the fan is regulated for each fan, and table data of the temperature and the target number of the rotations for each fan as illustrated in FIG. 3 are stored in the ROM 174. The CPU 171 performs the control so that the number of the rotations of the exhaust air fans 89*a*, 89*b*, 89*c*, 89*d*, and 89*e* are set as the number of the rotations determined in step S2204 (S2205).

As described above, according to the embodiment of the present invention, it is possible to provide the image forming apparatus capable of dealing with the decrease in the melting point of the toner through the environment control by detecting the temperature of the inside of the image forming apparatus more accurately without increasing the costs.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-305994 filed Nov. 27, 2007, which is hereby incorporated by reference herein in its entirety.

What is claimed is:

1. An image forming apparatus to which a developer storage container can be detachably mounted, the image forming apparatus comprising:

a reception unit arranged to receive information from the developer storage container;

a first temperature detection unit provided in an inside of the image forming apparatus and arranged to detect a temperature of the inside of the image forming apparatus;

a cooling unit arranged to cool the inside of the image forming apparatus; and a control unit arranged to determine on the basis of the information received by the reception unit whether the developer storage container is provided with a second temperature detection unit, and to control the cooling unit on the basis of a detection result of the first temperature detection unit in a case where it is determined that the developer storage container is not provided with said second temperature detection unit, and to control the cooling unit on the basis of detection results of the first and second temperature detection units in a case where it is determined that the developer storage container is provided with said second temperature detection unit, wherein the reception unit receives temperature information related to a temperature detected by the second temperature detection unit from the developer storage container in a state in which the developer storage container is not mounted to the image forming apparatus, and wherein in a case where the temperature information received by the reception unit exceeds a predetermined temperature, the control unit displays on an operation unit provided to the image forming apparatus a message indicating that the temperature is too high.

2. The image forming apparatus according to claim 1, wherein the developer storage container includes a wireless IC chip for performing a wireless communication, and wherein the reception unit receives the information by performing the wireless communication with the wireless IC chip provided to the developer storage container.

3. The image forming apparatus according to claim 1, further comprising:

a storage unit arranged to store information indicating a corresponding relation of the first temperature detection unit, the second temperature detection unit, and the cooling unit as information indicating the detection result of which temperature detection unit is used for controlling the cooling unit, wherein the control unit controls the cooling unit on the basis of the information stored in the storage unit.

4. The image forming apparatus according to claim 3, further comprising:

a mounting detection unit arranged to detect whether the developer storage container is mounted to the image forming apparatus, wherein the control unit controls the reception unit to receive the information from the developer storage container in accordance with a detection result of the mounting detection unit to update a storage content in the storage unit on the basis of the received information.

5. The image forming apparatus according to claim 4, wherein when the mounting detection unit detects that the developer storage container is mounted to the image forming apparatus, the control unit controls the reception unit to receive the information as to whether the developer storage container is provided with the second temperature detection unit to update the corresponding relation of the first temperature detection unit, the second temperature detection unit, and the cooling unit stored in the storage unit on the basis of the received information.

6. An image forming apparatus to which a developer storage container can be detachably mounted, the image forming apparatus comprising:

a reception unit arranged to receive information from the developer storage container;

a first temperature detection unit provided in an inside of the image forming apparatus and arranged to detect a temperature of the inside of the image forming apparatus;

a cooling unit arranged to cool the inside of the image forming apparatus;

a control unit arranged to determine on the basis of the information received by the reception unit whether the developer storage container is provided with a second temperature detection unit, and to control the cooling unit on the basis of a detection result of the first temperature detection unit in a case where it is determined that the developer storage container is not provided with said second temperature detection unit, and to control the cooling unit on the basis of detection results of the first and second temperature detection units in a case where it is determined that the developer storage container is provided with said second temperature detection unit;

a storage unit arranged to store information indicating a corresponding relation of the first temperature detection unit, the second temperature detection unit, and the cooling unit as information indicating the detection result of which temperature detection unit is used for controlling the cooling unit, wherein the control unit controls the cooling unit on the basis of the information stored in the storage unit; and a mounting detection unit arranged to detect whether the developer storage container is mounted to the image forming apparatus, wherein the control unit controls the reception unit to receive the information from the developer storage container in accordance with a detection result of the mounting detection unit to update a storage content in the storage unit on the basis of the received information, and wherein when the mounting detection unit detects that the developer storage container is detached from the image forming apparatus, the control unit controls the reception unit to receive the information as to whether the developer storage container is provided with the second temperature detection unit to update the corresponding relation of the first temperature detection unit, the second temperature detection unit, and the cooling unit stored in the storage unit on the basis of the received information.

7. An image forming apparatus to which a developer storage container can be detachably mounted, the image forming apparatus comprising:

a reception unit arranged to receive information from the developer storage container;

a first temperature detection unit provided in an inside of the image forming apparatus and arranged to detect a temperature of the inside of the image forming apparatus;

a cooling unit arranged to cool the inside of the image forming apparatus; and a control unit arranged to determine on the basis of the information received by the reception unit whether the developer storage container is provided with a second temperature detection unit, and to control the cooling unit on the basis of a detection result of the first temperature detection unit in a case where it is determined that the developer storage container is not provided with said second temperature detection unit, and to control the cooling unit on the basis of detection results of the first and second temperature detection units in a case where it is determined that the developer storage container is provided with said second temperature detection unit, wherein the reception unit receives from the developer storage container data indicating where the second temperature detection unit is located in the developer storage container.

* * * * *